US007261182B2

(12) United States Patent
Zainea

(10) Patent No.: US 7,261,182 B2
(45) Date of Patent: Aug. 28, 2007

(54) WIDE BAND SOUND DIFFUSER WITH SELF REGULATED LOW FREQUENCY ABSORPTION AND METHODS OF MOUNTING

(76) Inventor: Liviu Nikolae Zainea, 14 Peresiadou Street, Athens (GR) 11141

( * ) Notice: Subject to any disclaimer, the term of this patent is extended or adjusted under 35 U.S.C. 154(b) by 142 days.

(21) Appl. No.: 10/510,760

(22) PCT Filed: May 15, 2003

(86) PCT No.: PCT/GR03/00016

§ 371 (c)(1),
(2), (4) Date: Sep. 20, 2005

(87) PCT Pub. No.: WO03/098595

PCT Pub. Date: Nov. 27, 2003

(65) Prior Publication Data

US 2006/0042875 A1 Mar. 2, 2006

(30) Foreign Application Priority Data

May 21, 2002 (GR) ..... 20020100240

(51) Int. Cl.
*E04B 1/12* (2006.01)

(52) U.S. Cl. ..... 181/293; 181/30; 181/286

(58) Field of Classification Search ..... 181/293, 181/30, 286

See application file for complete search history.

(56) References Cited

U.S. PATENT DOCUMENTS 6,112,852 A * 9/2000 D'Antonio et al. ..... 181/295

6,772,859 B2 * 8/2004 D'Antonio et al. ..... 181/293

* cited by examiner

*Primary Examiner*—Lincoln Donovan
*Assistant Examiner*—Jeremy Luks

(57) ABSTRACT

The present invention relates to an acoustical diffuser device, said apparatus comprising the main body from FIG. 1 and two lateral rigid supports (5), glued to the inside of the said diffuser which lateral supports are received, like a drawer, by two wooden rails (6), section T. The two wooden rails (6) are simply mounted on the wall or ceiling surface with screws or nails. The main diffuser body with his two drivers is mounted just like a drawer toward the two rails T or is embedded into the complex endless-screw containing base from FIGS. 6 (1, 9, 10, 11, 12, 13, 14, and 15). The main body is composed from three basically 3D shapes (1, 2, 3, and 4). Each fourth diffusers, displays together a new 3D shapes at their nearest point, FIGS. 10, 11 and 12. This diffuser may be used in any kind of room and geometry where the critical listening is needed such live or recorded music and music teaching. His main advantage is that it is working simultaneously in two ways: as a clean diffuser for mid and high frequencies and as a self controlled absorber, below 250 Hz, for low frequencies, as from FIG. 1 and related figures and very low frequencies when the apparatus from FIG. 6 is used. This is possible, because being mounted in two new different ways, his compartmented volumes behind the diffuser surfaces works like a complex Helmholtz resonator. There are described methods for mounting it for one and four grouped apparatus.

3 Claims, 17 Drawing Sheets

FILE: MEULDALL.P30
Front to Back

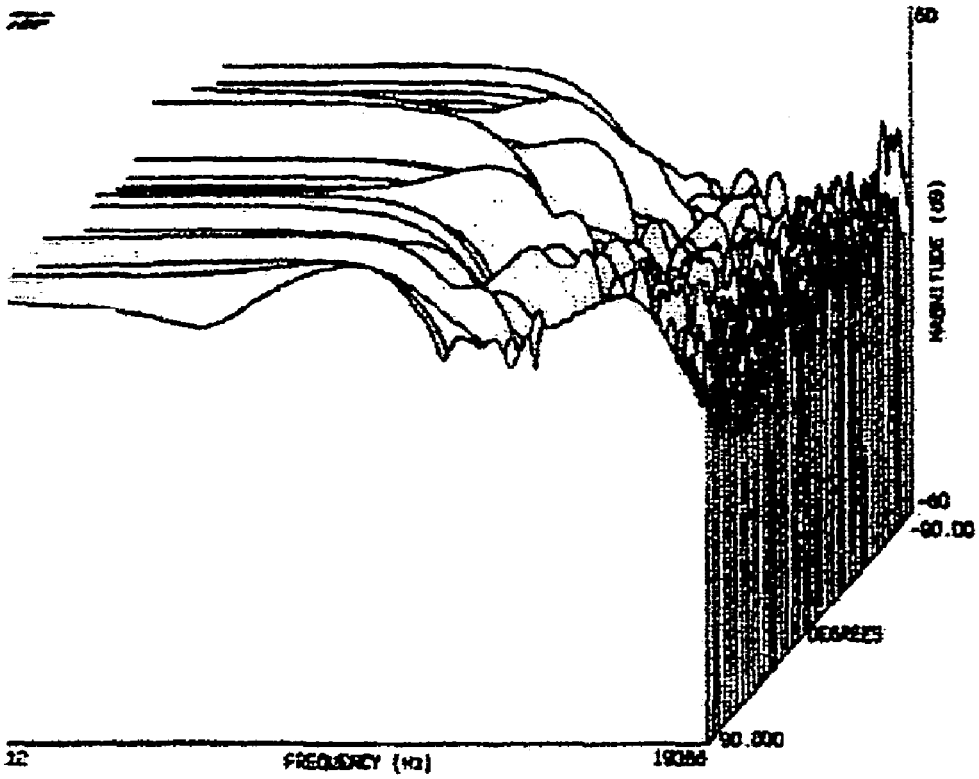

FILE: FULL.P30
Back to Front
Angle Step = 5.0 degrees 0 dB is 0.00002 Pa

Job Description:
FULL RANGE MEASUREMENT

SWEEP:

| | | |
|---|---|---|
| Start Frequency: | 11.5 | Hz |
| Stop Frequency: | 19388.4 | Hz |
| Sweep Time: | 0.427 | seconds |
| Distance Resolution: | 0.3 | meters |
| Frequency Resolution: | 1113.6 | Hz |
| Time Resolution: | 0.9 | milliseconds |
| Receive Delay: | 4.502 | milliseconds |
| Start Angle: | -90.000 | degrees |
| End Angle: | 90.000 | degrees |
| Number of Samples: | 1024 | |
| Number of Curves: | 37 | |
| Octave Smoothing: | 0.0 | percentage |

Fig. 18

WIDE BAND SOUND DIFFUSER WITH SELF REGULATED LOW FREQUENCY ABSORPTION AND METHODS OF MOUNTING

BACKGROUND OF INVENTION

The main purpose of this invention is to improve clearly all previous inventions of all times, both as practical devices or just theoretical ones, all to be found in the international bibliography. Until our device, said apparatus, all previous inventions are characterized by the calculated or measured absorption and also by a factor named diffusion capability. These characteristics are embedded and may be shown from the polar plots measurements. Is a big effort, redirecting the whole diffuser philosophy: from absorptive to clean diffusing, simultaneously being only a low frequency self-adaptive variable low frequency resonator. Here, it was analyzed almost all bibliography around acoustical diffusers, some of them shown at the Table T1 and Table 2.

The diffusers, until now, may be described theoretically and theirs predicted characteristics named diffusion ability are shown as polar plots, for various incidence angles, the additional absorptive curves being supplementary. The diffusion and absorptive ability of predicted acoustical diffusers are common and expected and for the real, practical diffusers. All those polar plots, usually taken each 5 degree of microphone position, shows the acoustic pressure of the reflected waves, and a semi circle shape is considered the "ideal", meaning that the named diffuser controls the interfering reflections in such a way that scatters the incident sound uniformly so that the acoustic glare in all directions is minimized.

To become being more precise, the acoustical diffuser designer, concludes that, whatever the place for diffusers to be installed, their dimensions, especially the depth, the smaller—the better. Practically it is very difficult to reduce all physical dimensions and acquire maximum or ideal characteristics. The principle of superposition is hardly tested because there are a multitude of phenomena arriving at once. If the diffuser shows one or more irregularities in his polar plots measurements at that particular angle, the diffusing ability is reduced and D tends to zero. Must be noted that for those frequencies and angles of incidence, the acoustical diffuser is working like as an absorptive surface, the notch being more or less obtrusive toward the supposed source's linear shape.

When the diffusion ability becomes high, a kind of source reinforcement may be perceived. This reinforcement may be associated with the loudness. If it is sound coloration or not, this is a difficult task to respond because our hearing and the physical acoustical phenomena are a complex interaction between linearity and non-linearity.

Around practical commercial diffusers, there is a confuse approach, because they appears as having either high diffusing ability and negligible absorption, or the characteristics are shown but the explanations done are misleading even for the specialist. For many years, was kept as advantageous, the absorption ability or more correct the disability of the named diffusers to not have a small percent of absorption. There is a sensible difference as what is perceived and understood as good or bad around the term absorption and his role in music—live or recorded.

This difference is wider than expected and differentiated between US and European listeners. Even the highest "golden ears" gifted persons are in difficulty of being totally objectives in their appreciations, simply because the educational background is not similar. At the actual technical/cultural levels, as much as the electronic device will replace the real organs, the "golden ears" of gifted people, able to hear 1 dB or 1 Hz J.N.D.'s (the just noticed audible differences) and people who loves and remember the timbre of real organs, will become less and less. Thus, the difficult obtained hearing abilities will be slowly lost. From the all those many notches, the music, as well recorded as may be, will be distorted. Here, music is named every kind of sound resulted from a musical instrument, voices or choirs and any type of reproduced sound in monaural, stereophonic or multi channel format.

Basically the sound in real life, may be absorbed, reflected or diffused. There are two strictly differentiated but hardly understood (even by some sound specialists) categories: one is the sound quality, especially inside of any kind and any room dimension and the second is the sound insulation related to the sound level and spectral content transmitted between rooms. In case of two noisy adjacent rooms with poor sound insulation between them, never, there will be any sound quality quantification or proper sound quality tests. Inside an enclosure or room, there will be certain areas in x, y, or z directions where the sound distribution/diffusion will be irregular, far from the required symmetry, as an homogenous and coherent field which is supposed to be a real life musical audio performance or a reproduced one.

Before continuing with our acoustical diffuser device, said apparatus, some explanations. We are limited here, but we must note, that the interactive phenomena between purely physical and perceptual aspects of what kind and where the absorption is necessary and if the simple concept of diffusion and nothing else is better practically but less well understood. There are some factors influencing and helping in perceiving the named sound quality. Here some arguments, first regarding technical hearing and then some psychoacoustical details. Surely there is some special auditory sensitivity required in order to be sound experts.

This we describe what we mean by professional auditory sensitivity. As a basic ability, sound professionals should have the ability to 5 discriminate between different sounds. The first step is discerning a difference. After learning to recognize a difference, the sound professional should be able to identify various types of perceived differences, such as differences in pitch, loudness and timbre. These three elements are the most basic auditory aspects of sounds.

However, the ability to discriminate is not sufficient. Sound professionals should also develop the ability to correlate the auditory difference with the physical properties of sounds. The sound professional should expect to come across numerous technical terms expressing acoustic features, e.g. sound pressure level, frequency, and spectrum. When a sound professional needs to explain an auditory difference, this difference should be expressed using the appropriate technical term.

Furthermore, the sound professional should be able to imagine the proper sounds when given the acoustic properties of the sounds, just as expert musicians can imagine music by looking at a score. Design plans and specifications are described by the acoustical technical terms: e.g. transmission loss or reverberation time. Sound professionals should be able to imagine sounds upon inspection of specifications. When controlling audio equipment, the sound professional should be able to imagine the controlled sounds.

For example, when recording engineers use sound effecters, such as equalizers and reverb processors, they can anticipate the processed sounds before controlling the effecter. Through technical listening training, music devoted people can improve their sound sensitivity and understanding of the relationship between acoustic properties and auditory impression.

There is a scientifically field named psychoacoustics, which try to explain our bionic interaction with the environment. Basic psychoacoustical research is mainly directed toward such topics as directional hearing, pitch, timbre and loudness perception, auditory scene analysis (the separation of sound sources and acoustical parameters from sound signals) and related lower functions, such as the workings of our ears, neural coding of auditory signals, the mechanisms of interaction between multiple simultaneously heard sound sources, neural pathways from ears to the auditory cortex, their development and the role of evolution in the development of hearing. Psychoacoustical research has resulted in an enormous amount of data which can readily be applied to sound compression, representation, production and processing, musicology, machine hearing, speech recognition and composition. Our hearing system from the beginning of humanity serves to prevent us from enemies, protecting and offering survives chances. This is where the startle and orientation reflexes come in: sudden noises or movement tend to cause a rapid fight or flight reaction and even weaker, unexpected stimuli cause one to locate the sound source by turning the head towards it. Since unexpected, sudden features in the heard sound tend to cause such effects and generally arouse the central nervous system, it can be conjectured that notes may well have some very deep seated physiological meaning to people—they do tend to start with transients and cause fixing of attention.

In contrast, people-hear time features in sounds as well. So there is still the question of how the masking effect of a particular sound develops in time. When we study masking effects with brief tone bursts, we find that masking extends some tens of milliseconds often quoted as 50 ms, backwards and one to two hundred milliseconds forward in time. The effect drops approximately exponentially as the temporal separation of the mask and the masked increases.

These results too can be explained by considering what happens in the basilar membrane of the ear when sonic excitation is applied—it seems backward and forward masking, as these are respectively called, are the result of the basilar membrane's inherently resonant nature. The damped vibrations set of by sound waves do not set in or die out abruptly, but instead some temporal integration is always observed.

This same integration is what causes the loudness of very short sounds proportional to their total energy instead of the absolute amplitude-since it takes some time for the vibration (and, especially, the vibration characteristic of the envelope) to set in, the ear can only measure the total amount of vibration taking place, and ends up measuring energy across a wide band of frequencies. Similarly, any variation in the amplitudes of sound frequencies are smoothed out, leading to the ear having a kind of time constant which limits its temporal accuracy. Let's have a look at the FIG. 21, which is the Equal loudness curves in a free field experiment or "equiphon". The "equiphon" contours for the range of human hearing in a free field experiment, according to Fletcher-Munson and later, Dadson, Robinson (indicating the chronology). The phon contours correspond to the decibels. All sinusoids on the same contour (identified by sound pressure level and frequency) appear to have identical loudness to a human listener. It is seen that the dynamic range and threshold of hearing are worst in the low frequency end of the spectrum.

Also, it is quite evident that at high sound pressure levels, less dependency on frequency is observed (i.e. the upper contours are flatter than the lower ones). Of course the equiphon contours are statistically obtained curves, and each generation has his correction on this. Sinusoidal sounds close to each other tend to mask one another. If the sounds are far enough from one another—more than one critical and width apart, and the higher is sufficiently loud, they are heard as separate and contribute separately to loudness. In this case sones—the loudness units, are roughly added.

The human auditory system has, as mentioned in the introduction, some interesting properties, which are exploited in perceptual audio coding (supposed to emulate the human coding). We have a dynamic frequency range from about 20 to 20000 Hz, and we hear sounds with intensity varying over many magnitudes. The hearing system may thus seem to be a very wide-range instrument, which is not altogether true. To obtain those characteristics, the environment we are in. In the presence of a strong white noise, for example, many weaker sounds get masked and thus we cannot hear them at all. Some of these masking characteristics are due to the physical ear, and some are due to the processing in the brain. Since masking is most pronounced in the upward direction, a sound affects the perception of lower frequencies considerably less than higher ones—a sufficiently rapidly decaying spectrum; the lower partials dominate loudness perception. Also, sinusoids closer than the critical bandwidth are merged by hearing so their contribution to loudness is less than the sum of their separate contributions. The same applies for narrow and (bandwidth less than the critical bandwidth) noise. If beating is produced, it may, depending on its frequency, increase, decrease or blur perceived loudness. The pre-masking is too short to be exploited in the same way as in post-masking, but it is still important. Pre-masking comes in useful to hide the effect of pre-echoes, which can become audible in transient sounds.

Pre-echoes comes from the fact that quantized transform coefficients produce noise in all time instants in the time domain. A quiet signal block with a transient in the end (for example a drum) will thus be noisy even before the transient, where it can be heard. By making the transform blocks short enough—on the supposed correct human coding, this effect can be hidden by the pre-masking.

The experiment shows that the masking from the two maskers is approximately constant as long as the .DELTA.f—the difference frequency of maskers (is less than the critical bandwidth at that frequency). Thus, a masker can mask almost uniformly within the critical band. Masking does not only occur within the critical band, but also spreads to neighbouring bands. A spreading function SF (z,a) can be defined, where "z" is the frequency and "a" the amplitude of a masker. This function would give a masking threshold produced by a single masker for neighbouring frequencies. The simplest function would be a triangular function with slopes of +25 and −10 dB/Bark, but a more sophisticated one is highly nonlinear and depends on both frequency and amplitude of masker. As much as all masking phenomena are reduced, so much music perception is easier for our brain, which is "lazy" enough; the inhibition mechanisms are strong in reducing and simplifying his sensorial activity. The cognitive domain or "gestalt" tries to analyze and explain all this from simple to very complex. The research evaluated so much, regarding music perception, that a clear separation between acoustics and psychoacoustics is no longer possible.

Similarly harmonics (whether actually present or born in the ear) of low frequency tones and the presence of transients may aid in the perception of the fundamental, thus affecting the audibility of real life musical tones as compared to the sine waves used in the construction of the above equiphon graph. The phon is not an absolute unit: it presents loudness relative to the loudness. Knowing the phons, we cannot say one sound is twice as loud as another one. Instead, we would wish an absolute perceptual unit. All that remains to be done is to get the phons at some frequency to match our perception. This is done by defining yet another unit, the sone. When this is accomplished, we can first use the equiphon contours to map any Sound Pressure Level—SPL to its equivalent loudness in phons at 1 kHz and then the mapping to sones to get a measure of absolute loudness. The other way around, if we want a certain amount of sones, we first get the amount of phons at 1 KHz and then move along the equiphon contours to get the amount of decibels at the desired frequency. Experimentally we get a power law between sones and phons, the mapping from sones to phons obeys a power function with an exponent of 0.6, 40 phons being equal to 1 sone. (0 phons, that are 0 dB, become 0 sones of course.) This way at high SPL the sone scale is nearly the same as the phon/decibel ones, while at low levels, small changes in sones correspond to significantly higher differences in phons. In effect, at low levels a perceptually uniform volume slider works real fast while at higher levels, it's just exponential. Globally, our hearing capability, statistically evolves, if qualitatively meaning towards more linearity, or not, difficult to decide. It's a noteworthy one when talking about hearing and time. That's the concept of the perceptual now the psychological equivalent of the present time. What is noteworthy about it is that the masking effect extends over a variable time span and in a multi resolution manner. Depending on what sort of sonic events we are looking at, the psychological now varies from milliseconds to entire seconds even while the different sounds overlap. The term on what sort of sonic events we are looking at is a sort of loudness definition, where attention is specifically and aurally distributed. It is what we name listening inside the music. Of course, any two events heard in the mentally coincide.

Regarding the low frequency problem, we have 2 situations: The first one is the static one. From one or more symmetric sources, emanating tones not music the eigenfrequencies have a more or less a regular form and almost "absolutely" symmetrical. In this situation if we put one or more "bass absorbers" in the room, even at the calculated necessary points, the action from the mentioned absorbers, are a topically filtering, i.e. producing notches or deeps in the spectrum, first locally and then in the nearer field. From the bibliography resulted that this kind of notches is like an open vane in a piscine—the water will tends to go out from there and the clear water surface will be disturbed. Another bass absorber at another place, calculated and built for another mode and bandwidth will again produce, there, in his 3D area another locally disturbance. With just 2 such a distant low bass absorbers, the room will have a serious modes distribution distorted. Think that all this is for, say, sustained tones, or just sweeping in frequencies, which cover at least the left and right absorbers margins. Supposing that the build up phenomenon will continue for few seconds more, then the "map" of all eigenfrequencies will be "stretched" and the symmetry will be lost. Like all phenomenon in rooms, the reflected waves will adds more anisotropy and overall, the new and continuing formatted modes "map" will stretch more the expected symmetry. Just putting more bass absorbers, cantered at other frequencies will disturb more the situation, and in the best situation will produce an overall low frequency notch. Aurally this will be sensed as bodiless or lack of energy. There is no sure relationship between such low frequency absorption and Fletcher-Dodson-Robinson loudness curves, simply because energetically, the massive or diaphragmatic bass frequency absorbers will not follow our hearing capacity as shown in the Loudness curves related with the source levels.

At low levels, almost all bass absorbers—commercially or at the research level available, will react little or very little with the low frequency energy. The "stretched modes maps" will stay like that and because the Loudness curves, statistically have proved as being true, there will be less proved "work" to our ears done by the bass absorbers. As the low level source increase, the low frequency absorbers, the way they are mounted will interact more or less efficiently. The existence of more than one bass absorber in a room will have in the build up time and after that a non symmetric action, resulting, for a symmetrical two sources situation, an "image stretching". Even for steady tones or slow sweeping, the sweet spot will be gone. More, turning slightly our head left and right, the already non symmetric situation will be more disturbed. Note that until now, at the research or practical level, there was not such a construction able to "filter down" or produce a notch exactly the same as calculated. There will be always a lateral "inflation" and preferentially related with the source level and position. The resulted bass absorption will differ enough from the calculated one. Please note also, that we never used the word music, searching only the symmetry situation. As you know, even in electrical signal processing, the filters are never "perfect". Even at this stage of analysis, the far away, child-toy kaleidoscope memory will not stay "absolutely" centred as our memory did.

The second situation is the "live" situation. We have the same situation as above, but replacing the tones or sweeping with music, just a 10-15 seconds from a recording containing few instruments, and surely a contrabass or an electric bass. With more than one bass absorber mounted on one or more of the room walls, the field will tends to be steady stretched from one more powerful energetically and level dependent absorption. Because there is impossible to have two bass absorbers, for two spectrum part, being mounted in the same place, there will be at least two moments in time, said t1 and t2, true, slightly different, because, now we are in the music domain, and we are not listen music in infinite spaces. The said t1 and t2 [resulted form the different time that energetically the incident waves enters and are "processed" by our experience from at least two bass absorbers] are still away from the threshold of more than 35 msec where the preceding effect becomes acting—two sources of a same signal separated in time by more than 35 msec are perceived by our ears as different. In small and medium sized rooms, the preceding effect wilt tends to be perceived only if the rooms are "naked" empty, and even the listener bodies being absent, an absurd situation.

Note that some absorption will results from our bodies as listeners, our clothes, small reflections from the equipment and loudspeakers. Even in extreme situations like an empty room used for music listening, the slight diffusion augments as the room become bigger and in the opposite situation, as the room is smaller and smaller or a cube, the natural diffusion will be covered by the more and more low frequency modes, and the word boominess will becomes more frequently pronounced. That is, as the room decreases in dimensions, the same sources producing no evident "low frequency damages" in bigger rooms will be a real problem.

Here is the moment to introduce the complex phenomena of masking and dynamic masking. The "war" of searching to calm the low and very low modes culpable of "boominess" but without reducing them so much in order to go the undesired direction of letting the listener without the bass energy, form where the music takes the body and contour and feeling of warmness. Seems a no way situation because one action will tend to cancel the other. The theoretical and practical way until now was even to electronically process the signal going to the loudspeakers or actively merging from them and electronically analyzing the acoustical result to continuously treat the signal in again electronically, or, to treat the room as much and as well as to have no disturbingly and annoying low modes, literally named "boominess". The first, electronically way, even with good results, put the listener in the "absolutely centre statue" position, even the slight head moving resulting in the stereo image loosing. The acoustical treatment has had always better results, but because of not exact filters—bass absorbers working there was always a more spectral energy absorption as needed. Please note, that we spoke nothing about the rest of the spectrum. If the bass gives the "hot" feeling, the music contour, the mid and high frequencies contains the music's details. Search a radio station broadcasting a kind of low-fi music, with very few mid and fewer high frequencies, and you, even "understanding" the music, you will feel that something is lost. In the opposite direction, which is much more frequently, meaning a real situation, if somebody is listening music from a radio station broadcasting without enough or little tow frequency contents, he will feel more annoyed. The signal "harshness" will keep him less time in pleasure. Hopefully enough, the (tow frequency) missing fundamental phenomenon—our brain salvation solution, will process the signal "reconstituting" for us and our only ears and perception, the not appearing—in life, tow frequency contents. This is a frequent situation from cheaper or small "transistors" radio units when mainly the information is asked and the music wilt just "embrace" our ears, as to the time wilt past nicer, a kind of pleasant "residual noise". From here to the HI-FI or HI-END situation is a very long road. So, we were in the situation where cleaning the bass in a known [until now] way, so many problems resulted and continue to result, that the music lovers wilt tends all the time—influenced by myriads of articles from periodicals, to buy or change the stereophonic equipments, a never ending situation. Regarding the perfectly diffuse sound field, we may read from: The Handbook of Acoustics—3rd Editions—F. Alton Everest, TAB Books, page 223: Even though unattainable, it is instructive to consider the characteristics of a diffuse sound field. Randall and Ward' have given us a list of these:

1) The frequency and spatial irregularities obtained from steady-state measurements must be negligible.

2) Beats in the decay characteristic must be negligible.

3) Decays must be perfectly exponential, i.e., they must be straight lines on a logarithmic scale.

4) Reverberation time wilt be the same at all positions in the room.

5) The character of the decay will be essentially the same for different frequencies.

6) The character of the decay will be independent of the directional characteristics of the measuring microphone.

These six factors are observation oriented. A professional physicist specializing in acoustics might stress fundamental and basic factors in his definition of a diffuse sound field such as energy density, energy flow, superposition of an infinite number of plane progressive waves, and so on. The six characteristics suggested by Randall and Ward point us to practical ways of obtaining solid evidence for judging the diffuseness of the sound field of a given room. End of citation from A. Everest.

Needless to say, our invention, acoustical diffuser device, said apparatus, at least from the measurements shown here, and much more from the listening tests, fulfils all the above conditions.

SUMMARY OF INVENTION

The present invention relates to an acoustical diffuser device, said apparatus comprising two lateral rigid supports, mounted to the inside of the said diffuser which lateral supports are received, like a drawer, by two wooden rails, section "T". The two wooden rails "T" are simply mounted on the wall surface with screws or nails. The main diffuser body with his two drivers is mounted just like a drawer toward the two rails T. The main body is composed from three basically 3D shapes. Each fourth diffusers, displays together a new 3D shapes at their nearest point. The angle between each 3D shape, including the new common shape and his neighbor's shapes is the same. From the total surface of each diffuser there is more than 90% diffusing surface. Except the wooden rails, section "T", the complex diffuser body and his lateral supports are fabricated from hard impact polystyrene or any material suitable for the device geometry using vacuum thermoforming, injection molding, blow molding facilities or any other suitable way, keeping the same device geometry, the lateral supports being added with adhesives or produced from the same material as one piece with the diffuser device main body.

The first advantage of this diffuser is that it works clean and effectively in the 250-6300 Hz ISO band, the large area where the voice and musical instruments spectrum are prominent and the human ear is more sensitive.

As a result of very small distance between each apparatus—less than 1 mm, and the special mounting procedures, the whole surface of a rectangular team of diffusers from our invention is like a compartmented plate, simply, but very steady supported at the two edges, at some distance from the mounting surface. The plate works like a Helmholtz resonator. There is a known experimental equation (T1) relating basically the diffuser's dimensions, distance from the wall and the distance between all diffusers. The Helmholtz type of resonance is so double. There is the diaphragmatic absorption as if supposed to result from the grouped diffusers, where this total surface is related with the (supposed) bigger wavelength for the low frequencies. "Supposed" because until now, experimentally resulted that especially in larger halls, the panels reflected bigger wavelength than that corresponding to their dimensions.

The parallel architectural acoustics for music hall with the small and medium size rooms is not brought here to confuse, but to show that are many not clearly explained problems in the two distinct fields of acoustics. Are they so distinct or not, this is another story. The second aspect of the Helmholtz type of resonance encountered in our grouped acoustical diffusers from this invention is that being mounted compartmented, each line or row of minimum 3 diffusers is like a "sub class" or part of the overall diffuser's surface. All the above analysis is maintained, only that, for each diffuser, the inside air resonance frequency bandwidth is higher than the resonance of the whole acoustical diffuser assembly. So, the grouped diffusers work simultaneously as an air resonator for different bandwidths in different units analogous with the spectral and time source contents. The measurements done with a miniature Bruel accelerometer, indicated similar very low plastic "box" resonance as from the heavy wood furniture located in the room. At source levels of less than 80 dB SPL, no diaphragmatic function may be sensed by hand or measured, but the acoustical diffuser assembly from at least 9 units, is working very well. For monaural source/s, all diffusers acts alike, but as soon as the source become stereo or multichannel, each apparatus from our invention, behaves and feels continuously different upon device surfaces, at least at the finger's edges touching. If applied, for 25 mm distance from the wall of 4 grouped diffusers, the equation (T1) shows that the smaller resonance frequency will be 58 Hz.

This means and imply—the measurements show enough flatness in this region, that the apparatus as hard plastic box don't have any significant flexures or material resonances, even at high SPL's. It is supposed that this extra flexures or diaphragmatic absorption would be the cause of a mix of low frequency absorption and a generator of second order vibrations, harmonics or non-harmonic with the main signal, which second order vibrations if real, could be considered as sound coloration. Because the acoustical diffuser assembly is free of self-vibrations, we deal only with the air vibration behind the diffusers surfaces as low frequencies absorber and a wide band diffuser from his exterior surface.

Here is the equation T1, fr=4 a/Dd and e=r/(r+w), where r=distance between diffusers w=diffuser width (for the Roundffusor1—the commercial name, width=length)

d=depth of diffusers [D=distance from the mount surface e=percent of open surface between diffusers fr=fundamental resonance frequency All this indicate that the grouped acoustical diffuser said apparatus works as a complex Helmholtz air cavity resonator offering absorption, enough linear, as shown in FIG. 18, down to some 5 Hz. It is known that those very low frequencies, as even 5 Hz that our invention indicates, are sub harmonics usually generated in small rooms by the low of modal resonance corroborated with loudspeakers inherent distortion in the very low band. Fact is that a rectangular group of 9 acoustical diffusers said apparatus deal with such a very low frequencies. Such a performance, from a very small diffuser's depth, is for the first time achieved practically.

The other advantage of our apparatus is his clean diffusing ability. As known, the polar plots are measured for 0, 45 or 60 degrees. Here we have to compare 4 kinds of polar 5 plots, all taken at an angle of 45 degrees: the "ideal" ones, as the semicircle from FIG. 13, the acoustical diffuser's ones, said apparatus from FIGS. 14, 15, 16, 17 and 18, the polar plots of a commercial gypsum diffuser of a pyramid shape from FIG. 19 and the polar plots of a commercial wood diffuser produced by a known US company shown in FIG. 20. The measurement setup for all described situation is similar with our apparatus measurement.

The shown measurements for the other 3 situations arrive from equivalent mounted diffusers surfaces bigger than ours, which is an advantage for them. We couldn't invent or fake their measurement results. It is also known that except for incident angle at zero degree, where many commercial diffuser present enough near semi circle polar plots, but still unregulated, as we proceed toward 60 degree off axis polar plots, the results are highly irregular for all commercial diffusers. More, the 3D lobes are distinctly irregular. The sole exception until now, the diffuser with his polar plots shown in FIG. 20 where the overall lobe is somewhat better and may be "felt" at no more than 2-3 meters, but only for a whole wall covered with such applications. What is felt is the diffused field.

Regarding the apparatus of the present invention if we compare the 4 groups of polar plots, the results are more than obvious. It may be expressed in words as such: the apparatus of preferred embodiments of the invention wherein is a wide band acoustical diffuser having the ability of low and very low frequency absorption. The wide band sound diffuser with self regulated low frequency absorption said apparatus will be extremely useful in the control rooms, Hi-Fi, home theatres, High-End or music halls, churches and of a big help in music schools of any level—for voice or real instruments.

BRIEF DESCRIPTION OF DRAWINGS

In the accompanying drawings, there are shown present preferred embodiments of the invention wherein like reference numerals are employed to designate like parts and wherein:

FIG. 18, a waterfall type diagram shows a full range measurement sweeping for the 12-19388 Hz.

DETAILED DESCRIPTION OF DRAWINGS

Figure 3:
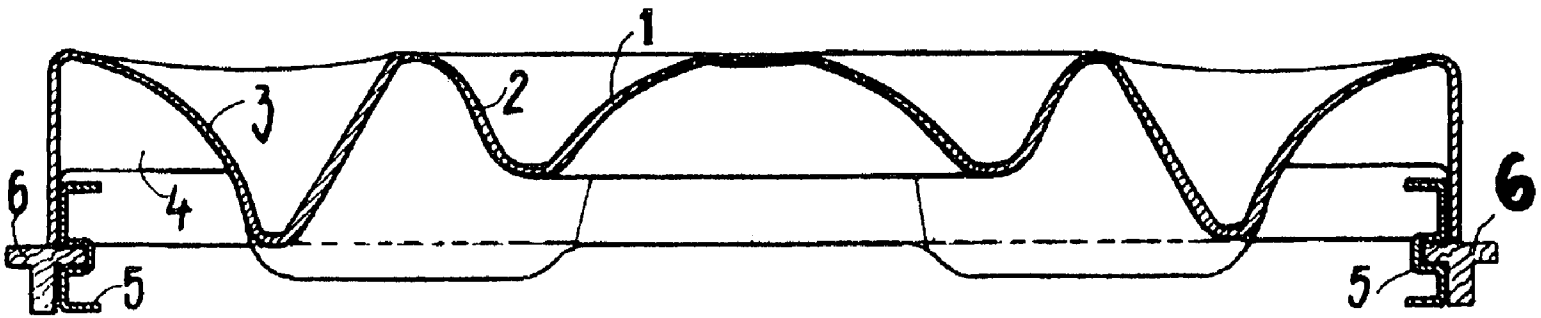
FIG. 3 is a cross-sectional view along the symmetry axe and perpendicular towards the plastic drivers (5) of a preferred arrangement of materials from a ready to be mounted apparatus.
Figure 4:
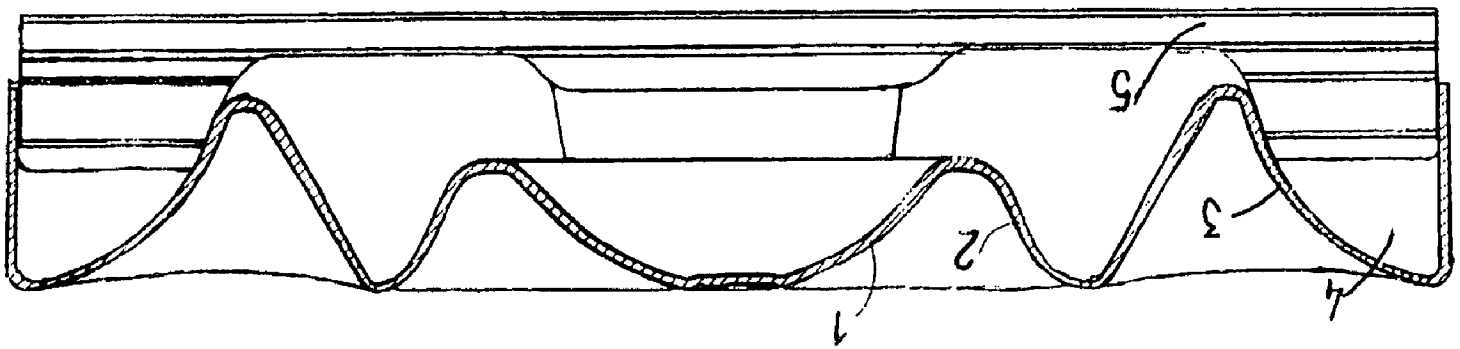
FIG. 4 is a cross sectional view along the symmetry axe, of a preferred acoustical diffuser panel said apparatus of FIG. 1, rotated 90 degrees relative to the cross-section from FIG. 3. It is shown completely a plastic drive (5) glued to the inside main diffusers body.
Figure 5:
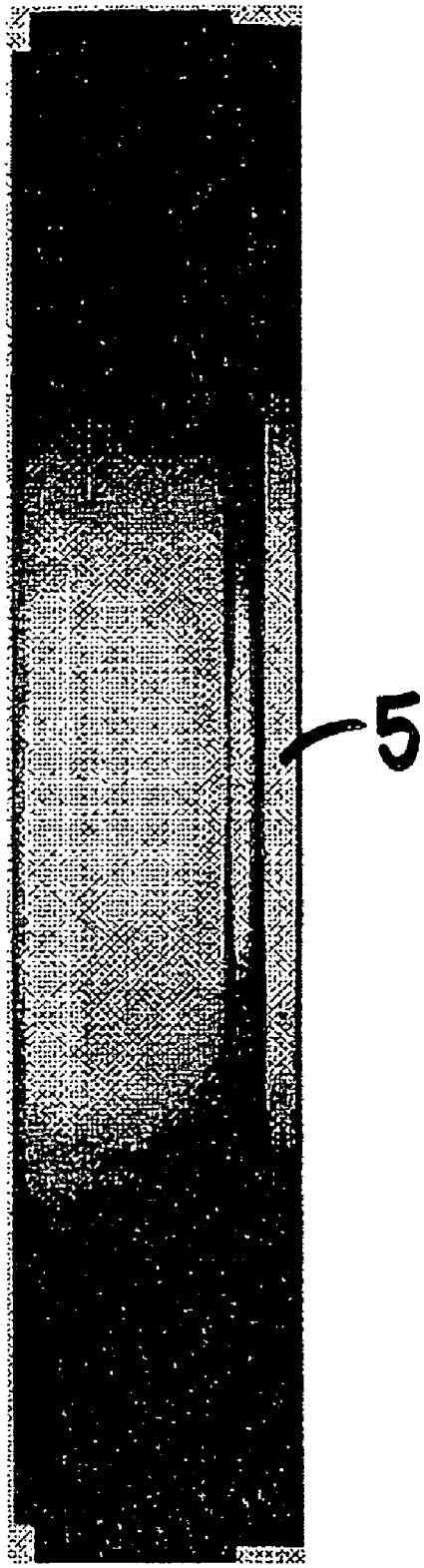
FIG. 5 is a lateral view of a preferred acoustical diffuser panel said apparatus, rotated 90 degrees relative to the cross-section from FIG. 3. It is shown the outside view of one of the two plastic drives (5).

In FIG. 3, the drivers (5) being made from the same material and thickness as the main diffuser's body, meaning hard impact polystyrene or any other suitable material, are very well glued, or made in one piece with the main device body, on the left and right, from the inside part of a preferred apparatus main body. The main body of a diffuser assembly of the present invention is comprising a hemisphere like shape (1) which is intersecting an octagon truncated pyramid (2) which is also intersecting on his left and right, two symmetrical one quarter cylinder shape (3) and two symmetrical shapes (4) which consist of a quarter hemisphere embedded into a prism which base prism is intersecting another lateral side of the central truncated pyramid (2). The angles between all intersected shapes are the same and equal. The apparatus geometry was optimized in order to have minimum horizontal surfaces, supposed to be purely reflective.

Figure 6:
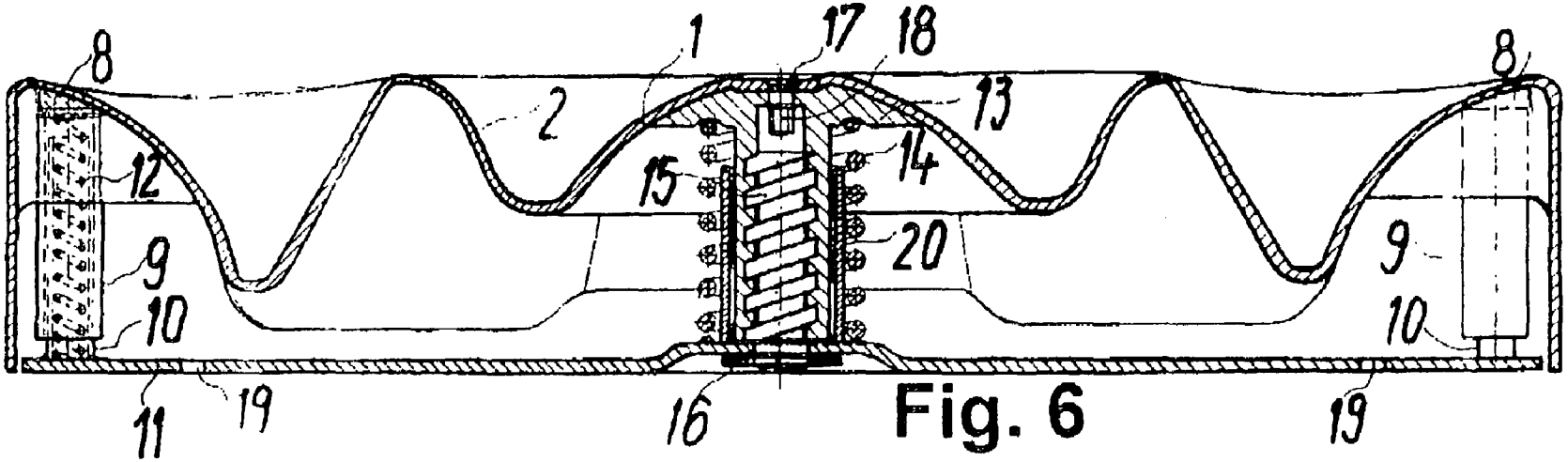
FIG. 6 is a cross-sectional view along the symmetry axe and perpendicular towards the plastic drivers (5) of a preferred arrangement of materials from a ready to be mounted apparatus.
Figure 7A:
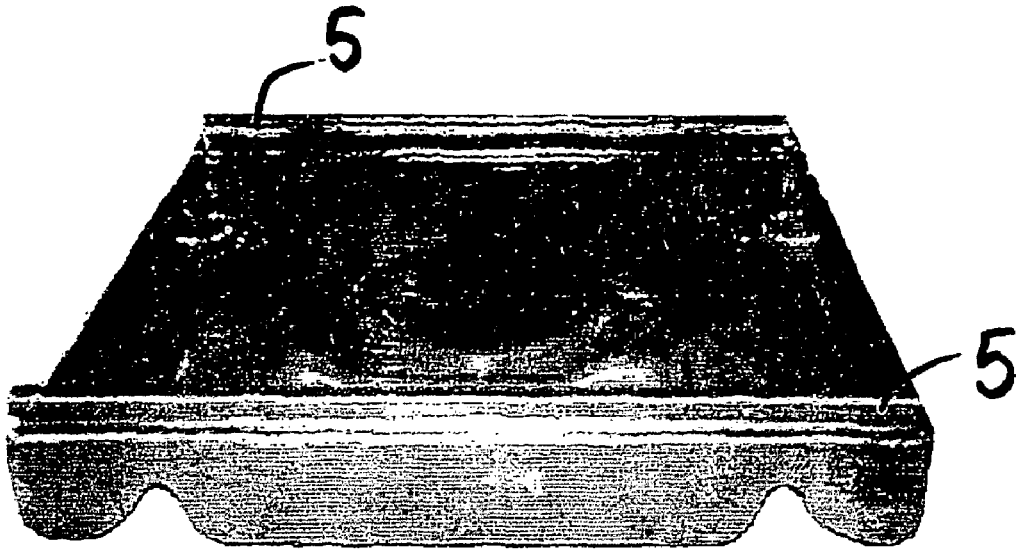
FIG. 7 (A and B) is a back perspective view of a preferred acoustical diffuser panel said apparatus of FIG. 1, with the two plastic drivers (5) clearly shown, the FIG. 7B having them 90 degrees rotated relative to the FIG. 7A.
Figure 7B:
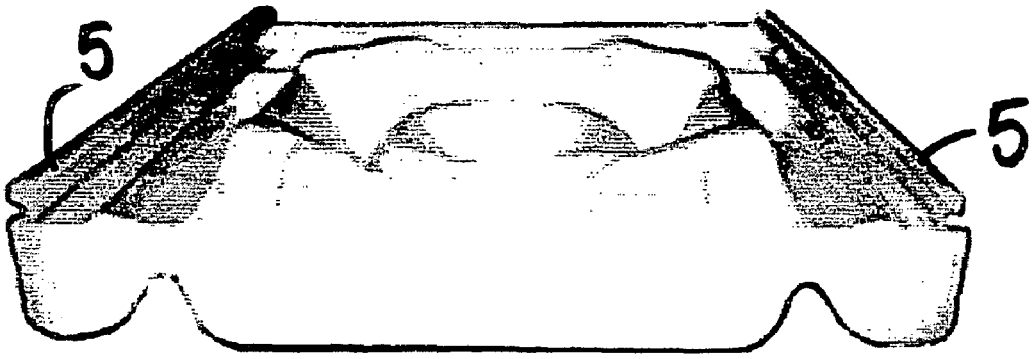
Figure 8:
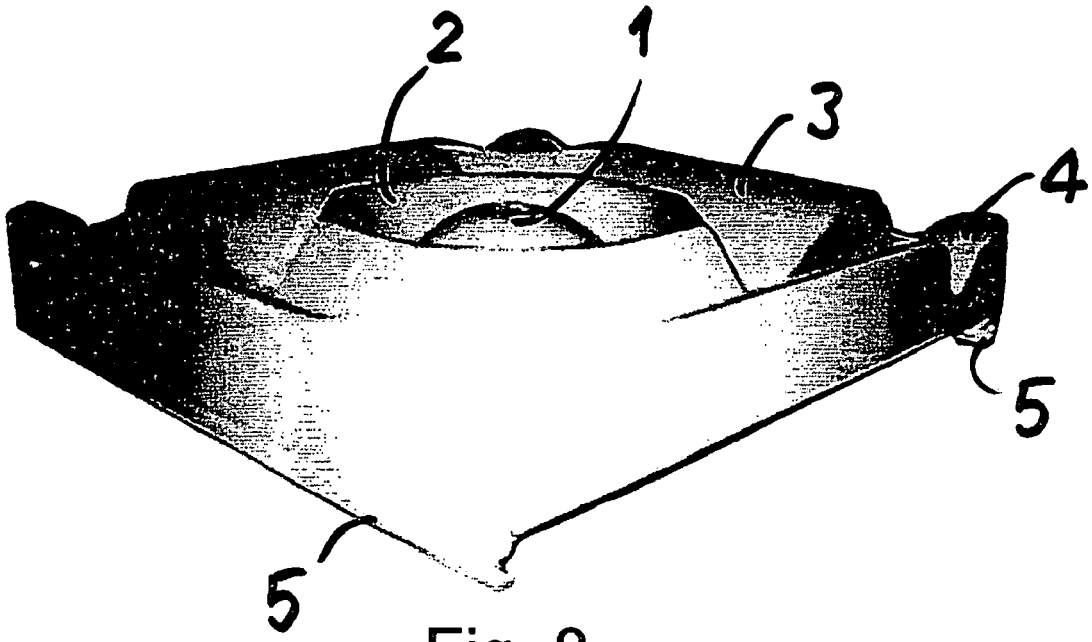
FIG. 8 is a frontal perspective view of a preferred acoustical diffuser panel said apparatus of FIG. 1, shown along one diagonal axe of symmetry.
Figure 9:
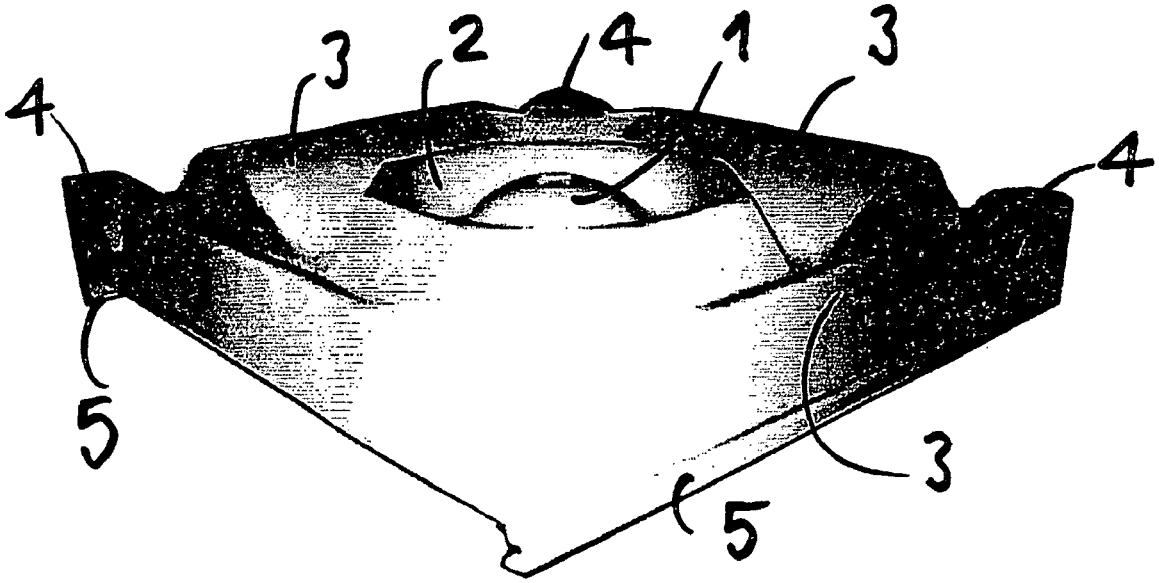
FIG. 9 is a frontal perspective view of a preferred acoustical diffuser panel said apparatus of FIG. 1 shown along one diagonal axe of symmetry but 90 degrees rotated relative to FIG. 8.
Figure 10:
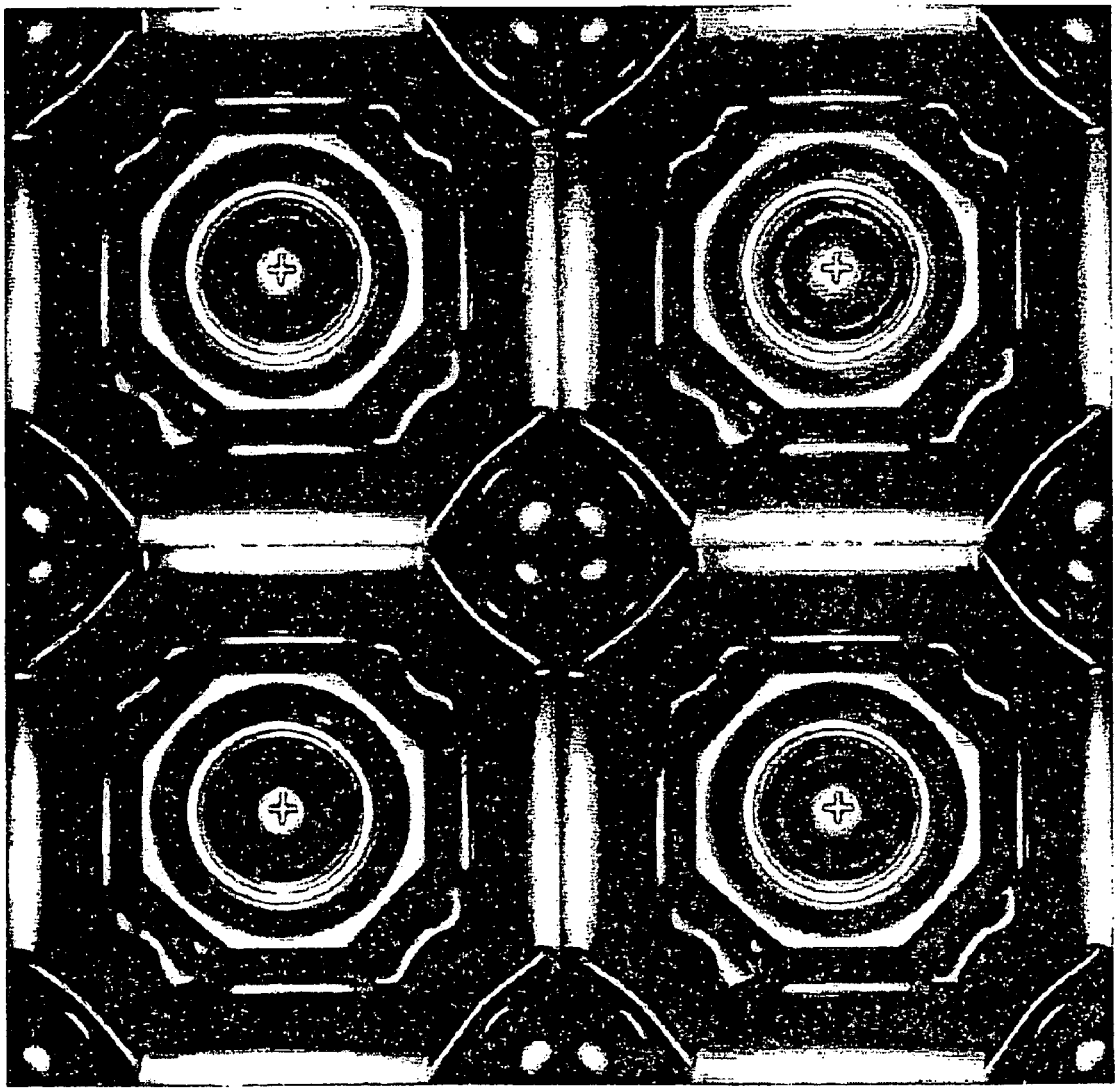
FIG. 10 is a frontal view of four grouped preferred acoustical diffuser panels of the subject invention. At the point where four apparatus comes in near contact, a new semi sphere exactly alike the semi sphere (1) found inside the central octagon truncated pyramid (2).
Figure 11:
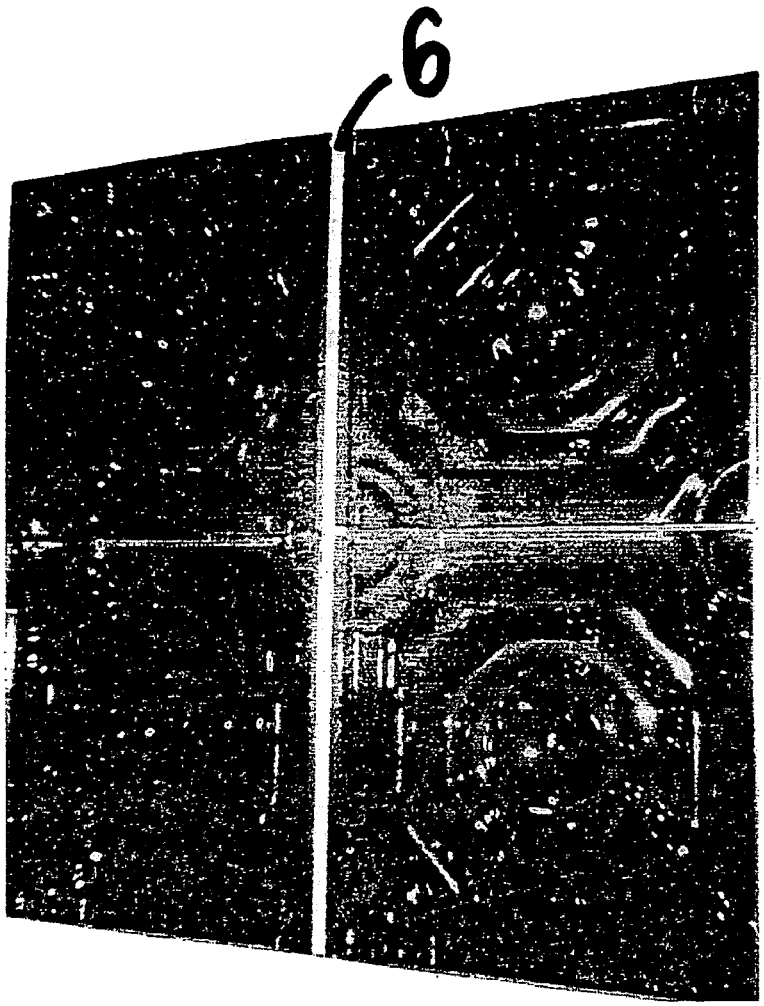
FIG. 11 is a back perspective view of four grouped preferred acoustical diffuser panels, where two plastic drivers (5) are mounted in tight contact like a drawer toward a common wood support of a "T" profile.
Figure 11A:
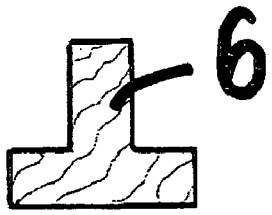
FIG. 11A is a cross-section of the wood support (6) of a "T" profile, with a length equal with the one of grouped apparatus. Each apparatus, in order to be steady mounted needs two wood supports.
Figure 12:
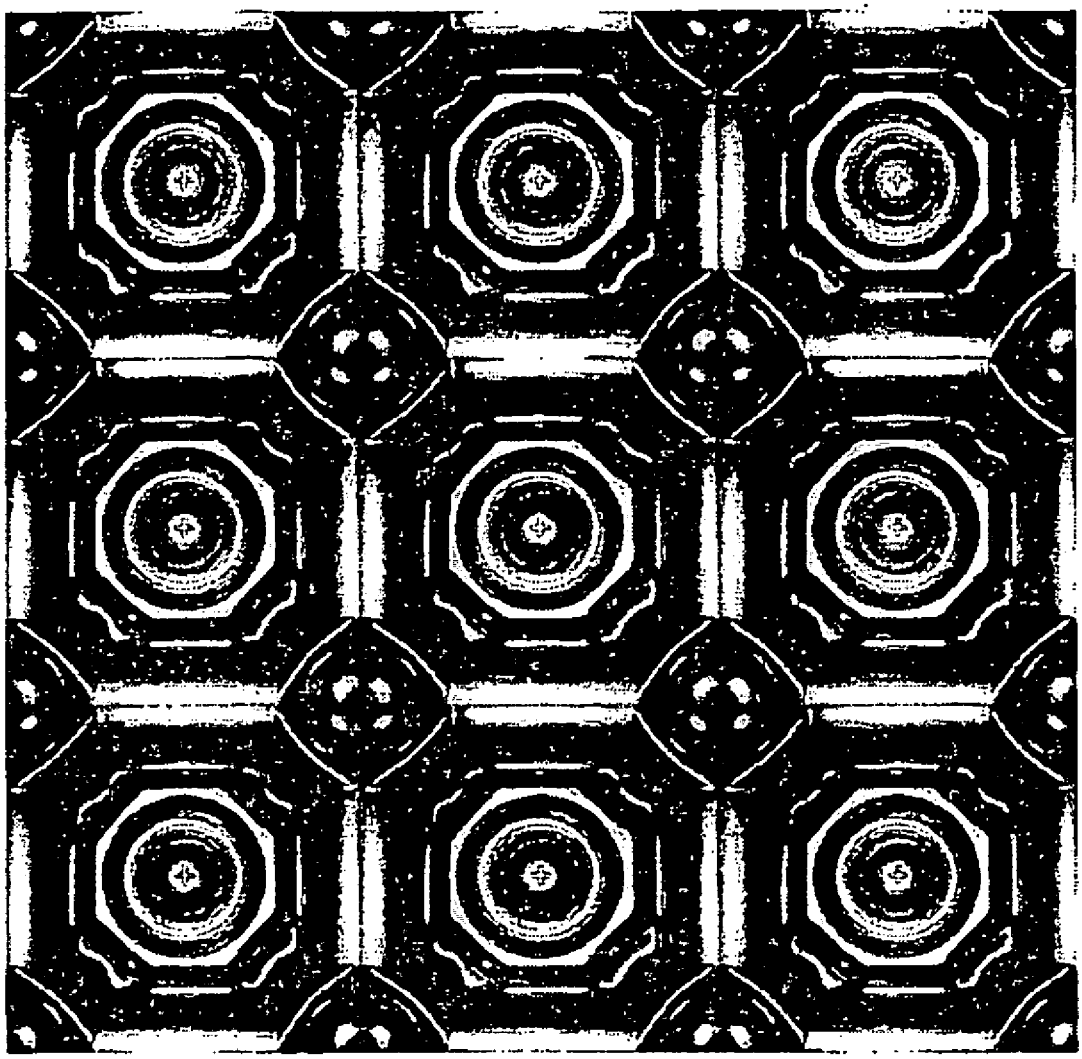
FIG. 12 is a frontal view of nine four grouped preferred acoustical diffuser panels of the subject invention. Again, at each point where four apparatus comes in near contact, a new hemisphere is formed, exactly alike the hemisphere (1) found inside and embedded into the central octagon truncated pyramid (2).

In FIG. 6, the main body of a diffuser assembly of the present invention is comprising a hemisphere like shape (1) which is intersecting an, octagon truncated pyramid (2) which is also intersecting on his left and right, two symmetrical one quarter cylinder shape (3) and two symmetrical shapes (4) which consists of a quarter hemisphere embedded into a prism which base prism is intersecting another lateral side of the central truncated pyramid (2). The angles between all intersected shapes are the same and equal.

More, if in FIGS. 3, 4, 7A, 7B, 8, 9, 10, 11 and 12 the apparatus with his two glued or being part of the main device body plastic drivers (5) are mounted in tight contact like a drawer toward a common wood support of a "T" profile, in the FIG. 6, a different kind of mounting is shown. There is a base (11), also made from vacuum thermoformed hard impact polystyrene, with an area equal with the apparatus main body minus his wall thickness, having in each of his four corners one plastic cylindrical shape (10), well glued upon the base (11). At the respective points, located at the four edges of the main's apparatus body, below his surface, there where the shapes (4) are highest, are glued four cylindrical shapes (9) which because haves a slightly different interior diameter from the cylindrical shape (10) clasps. The inside (9) and outside (10) surfaces of cylindrical shapes presents enough rough surface which corroborated with the tight contact between them (their relative diameters are almost alike) permits controlled movements. The springs (12), one for each assembly of shapes (9) and (10), are located inside the cylinders, between the base (11) and a limiter (8), and are pre loaded. The limiter (8) is parallel with the base (11) surface and allows a correct spring's function.

The variable mechanical connection between the base (11) and the main apparatus body is provided by an endless screw (15), with his screw-nut (16) end. That's it; the endless-screw spiral helped by (16) belongs to the base (11). The endless-screw's fixed part (13), is center located between the lower sides of the central hemisphere (1)—where is glued, with his hole (17), concentrically positioned relative to the geometrical centre of the base (11). The endless-screw and his fixed part (13) are made from any type of hard plastics. The endless-screw functioning is assured by key with a cross like section, to be inserted trough the hole (17) coaxial into the endless screw moving part at the point (18). His use is reduced to just further room tuning sort of loudspeakers replacements or furniture's changing. More, FIG. 6 contains a different spring (14) and his normal function is secured by thin plastic cylinder (20). The spring (14) provides a continuous loading between the diffuser's main body from FIG. 6 and his base (11). The force provided by the preloading of all four springs corners situated must be equal with the screw-nut's spring.

Figure 1:
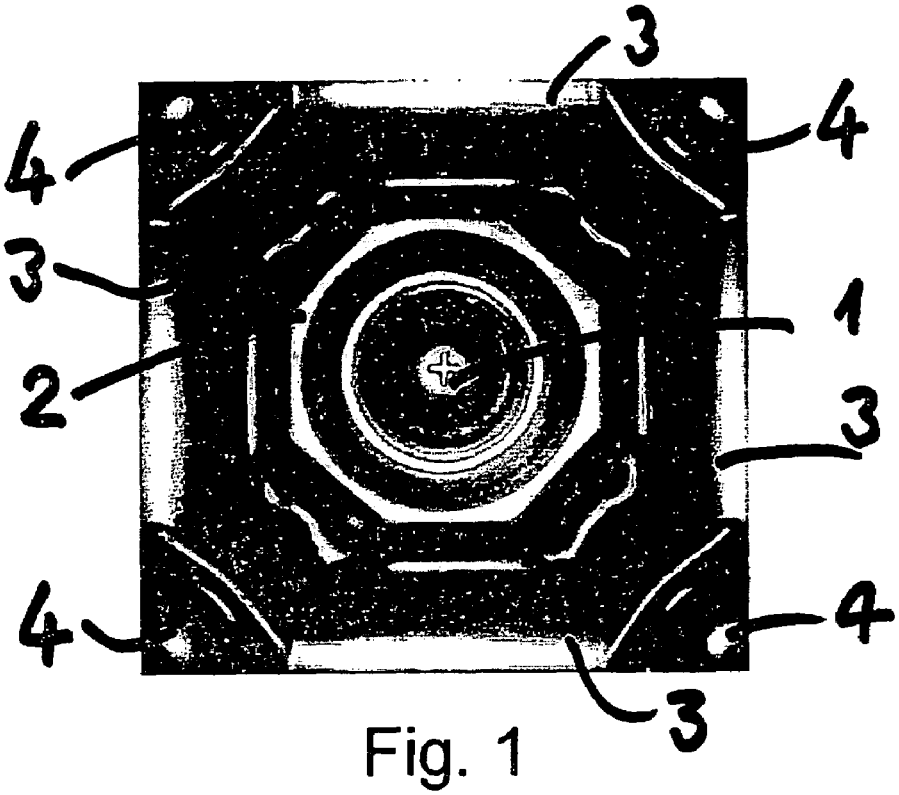
FIG. 1 is a frontal perspective view of a preferred acoustical diffuser panel said apparatus.
Figure 2:
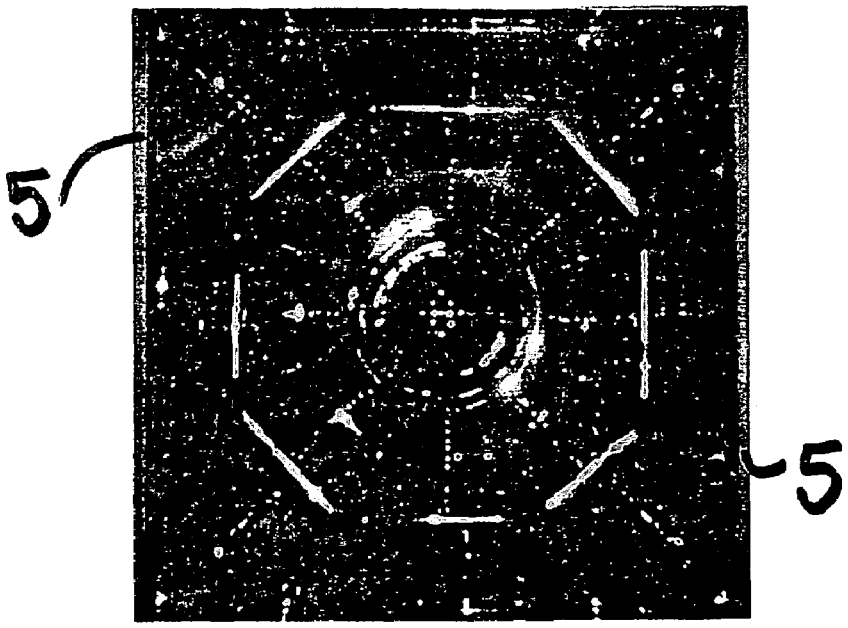
FIG. 2 is a back perspective view of a preferred acoustical diffuser panel said apparatus of FIG. 1.
Figure 1A:
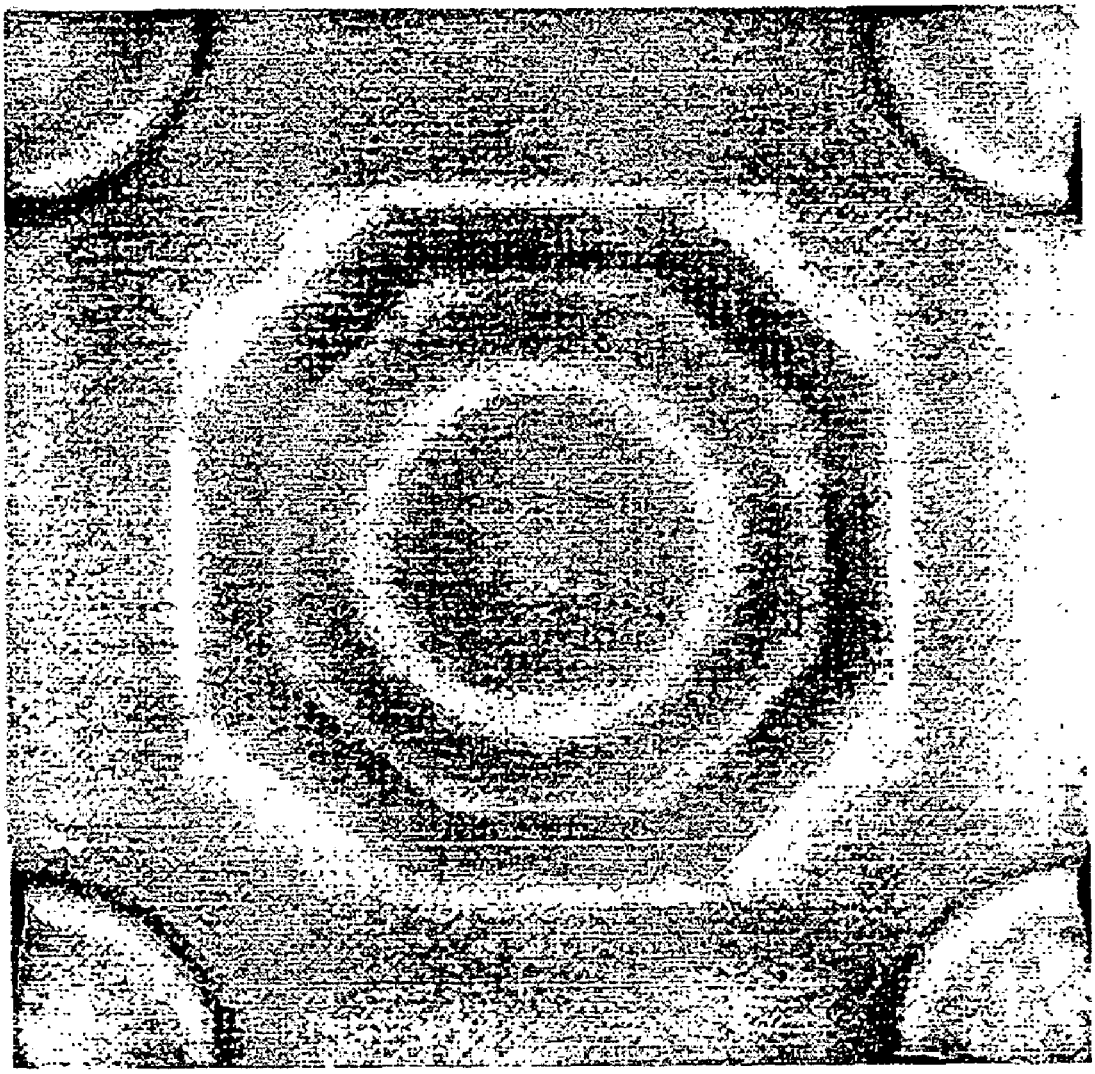
FIG. 1A is photographic frontal view of the diffuser, where the diffuser's body is made from non-painted white gypsum. The gypsum diffuser with exactly the same geometry as the said apparatus—in fact it is his initial mould, being exposed to flash light, shows the extremely high diffusing capability, being as a white smog as seen with our eyes.

The acoustical diffusers from FIG. 6, containing exactly the main body from FIG. 1 of the subject invention, are mounted grouped, showing the same external geometry as the grouped apparatus from FIG. 1. As the technology advances, the complex diffuser body and his articulated towards the endless screw base are fabricated from hard impact polystyrene or any material suitable for the device geometry using vacuum thermoforming, injection molding, blow molding facilities or any other suitable way, keeping exactly the same device geometry, the internal mechanism with all required supports being added with adhesives or produced from the same material as one piece with the diffuser device main body.

The types of springs and preloading, meaning their initial length are chosen in such a way, which in all situations does not permit any kind of vibrations of the suspended parts. In this way the preferred arrangement of assembled apparatus from the FIG. 6 of the subject invention is doing a clean diffusion above 250 Hz and a complex Helmholtz type of resonance for the low and very low frequencies. The calculations indicated that for a distance of 25 mm of the main apparatus body from FIG. 6 relative to his base (11), the lower fundamental resonance frequency may be around 58 Hz. If this distance goes to 50 mm, the lower fundamental resonance frequency may be around 30 Hz and so on. In practice, the apparatus of the subject invention from FIG. 1 and FIG. 6 is working at much lower frequencies that calculated, a complex situation resulted from the superposition diffuser/low frequency absorber in the same object.

There are some commercial applications, patented or not, announcing some resonating frequency somewhere between 60 and 80 Hz, never lower than that. These applications are voluminous and heavy working mainly on the diaphragmatic principle, and because are tuned to a limited bandwidth, the resulted high Q notches are surely there. More, being very voluminous they occupy expensive and useful space. When one diffuser from FIG. 6 is distanced from the base (11), all other diffusers from the grouped diffusers FIG. 6, are moved using the key to the same distance. The base (11) is mounted against the support surface of the wall or ceiling surface by screws from the three holes (19), in a triangle disposition for an easier alignment. This diffuser assembly from FIG. 6 needs a little more careful mounting procedure than the one from FIG. 1 of the subject invention, the symmetry towards the supporting surface and the equal distances between all mounted bases (11) being paramount.

So, the drawings are showing two kind of mounting of the subject invention. Their common part is the main diffuser body from FIG. 1. Regarding the drawings, FIGS. 1,2,3,4, 5,7,8,9,10,11 and 12, the wood supports (6) section "T", must be mounted on an enough plane surface, vertically or parallel to the ground. If the wood supports are mounted parallel with the axis loudspeakers—listening place, the axial modes are first processed, the usual situation. The distances between two wood supports are measured such as to permit a very tight contact like a drawer towards the two lateral plastic drivers (5). It is obvious that, either in a horizontal or vertical mounting, the two wood supports (6) allows free the other two lateral sides of each apparatus. In this way, horizontal or vertical columns are formed, sealed on two lateral parts and not sealed in the direction parallel with the plastic and wood drivers, there the air circulates freely and the atmospheric pressure is equal on both side of diffusers surface.

The apparatus of the subject invention from FIG. 1 and FIG. 6, is made from hard impact polystyrene, or any suitable material, his thickness and his careful way of mounting, even at high level of sound sources, doesn't permits any significant main body self resonance. Each line or column of grouped diffusers behaves like a firm plate steady supported at the two edges. The empty space behind each diffuser follows his back geometry and the resulted geometry from the grouped diffuser forms a complex Helmholtz resonator, extremely difficult to put in mathematics, where the lower frequencies are related with the highest points of the diffusers main body relative to the supported wall or base (11) and vice versa. Because at each grouped mounted diffusers of the subject invention, there are at least two columns of diffusers, in very tight contact, the air resonance behind each of them resonate at almost the same sound source spectral contents but not at the same sound levels, the 3D map of standing waves being continuously variable and follows their distribution according to the known physic laws. Sort of the optimized diffusers geometry and of their distance relative to the supported surface, the grouped diffusers acts like a self—adapted equalizer, meaning that the air behind them resonates at the needed points and as much is needed.

When tests were made, the diffusers of the subject invention indicated high linearity of resonance from any kind of sound source, be a sweeping signal or music. They do not allow any accentuation in frequency or time domain or tendency of asymmetric response from symmetrical sound fields. For the first time, these phenomena where identical from the acoustical measurements or at the perceptual level, or gestalt, at any kind of sound source intensity. More, the same as for the apparatus from FIG. 1, the research at the tests period, indicated that, except special applications when no or reduced bass absorption is required, is no need to try to fill the diffuser main body with fibrous materials simply because the diffuser is a self adapted low frequency resonator. In agreement with the ISO and IEC of Preferred frequencies and Octave-band and ⅓ fractional-octave-band filters, Table 2 (5, 6), the acoustical diffusers are characterized by their diffusion capabilities in the 250-6300 Hz bandwidth. The acoustical measurements made in rooms treated with the grouped diffusers of the subject invention are shown bellow. All the measurements were made with the single sound source 45 degrees off-axis relative to the diffusers plane. All others polar plots, from competitive applications where made in the same conditions and with the same methodology from international bibliography, Table 2 (1, 2 and 7). All measurements shown or indicated for comparison as from competitive applications were made with the spectrum analyzer TEF20.

Figure 13:
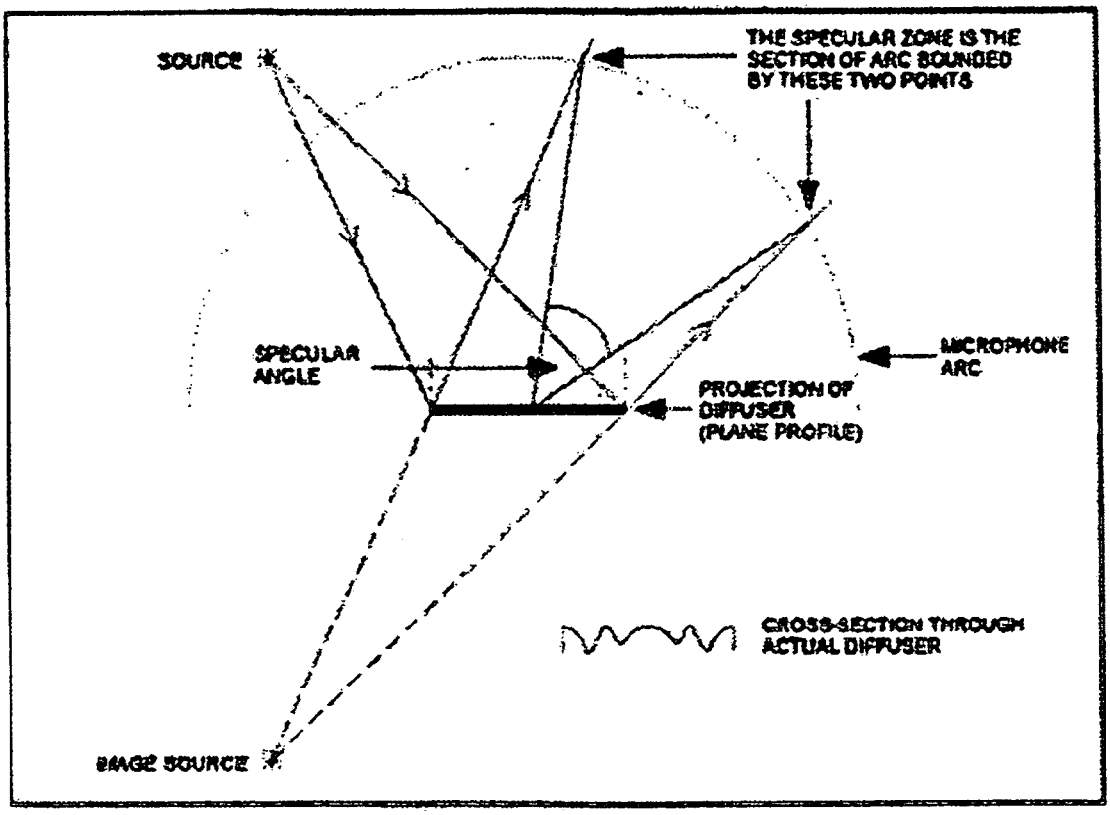
FIG. 13 shows an ideal diffusion curve resulting from the present invention.
Figure 14:
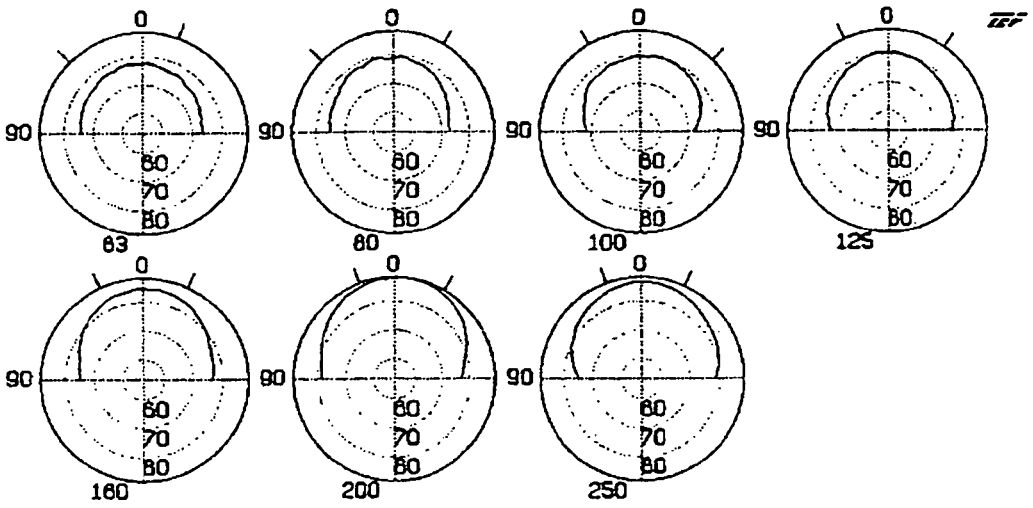
FIG. 14 is a polar plot diagram after sweeping for 63-250 Hz band, taken from a near field source, as the methodology permits.
Figure 15:
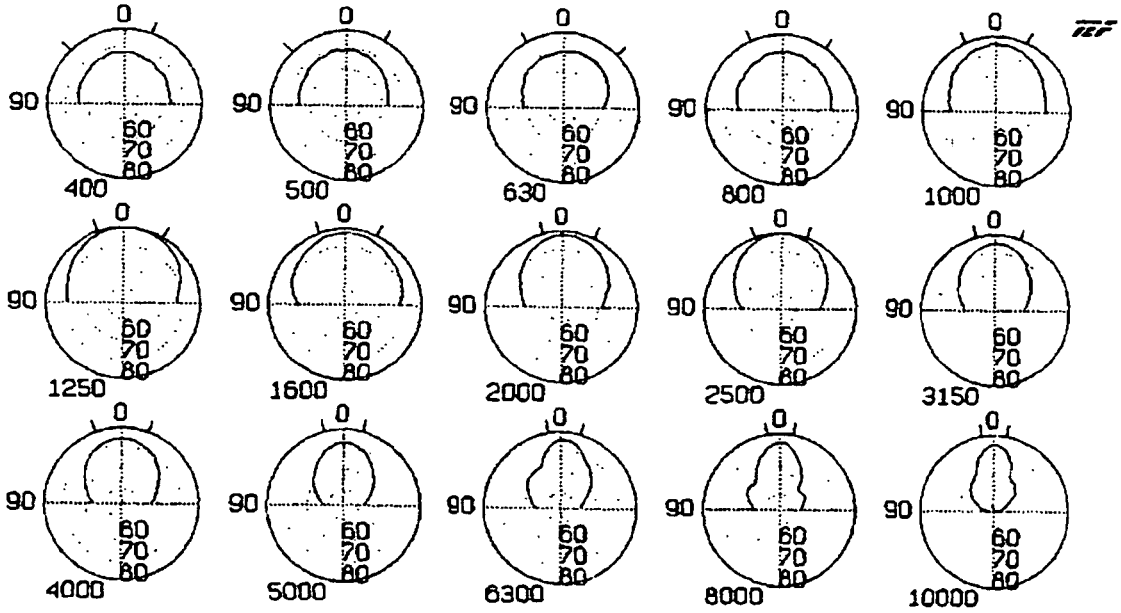
FIG. 15 is also a polar plot diagram for 400-10000 Hz, taken from 9 grouped diffusers of the subject invention from FIG. 1 same setup as in FIG. 14.
Figure 16:
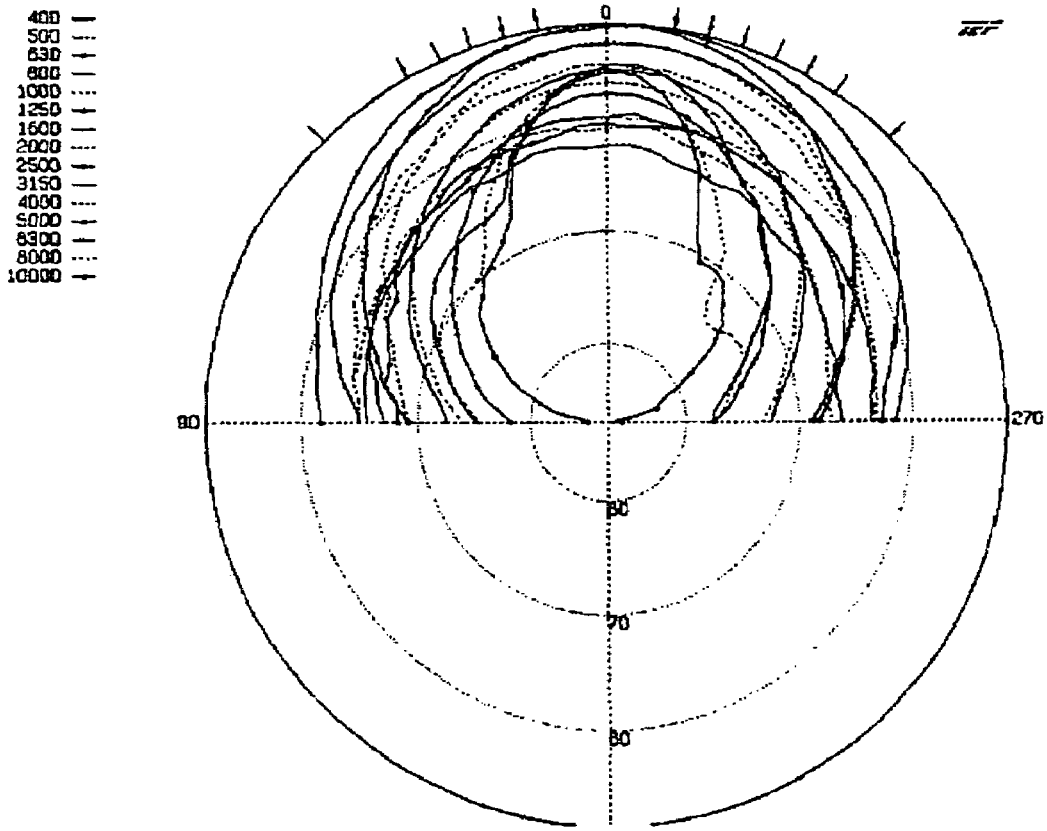
FIG. 16 is tile polar plot diagram with the same spectral contents as from FIG. 15 and his measurements.
Figure 17:
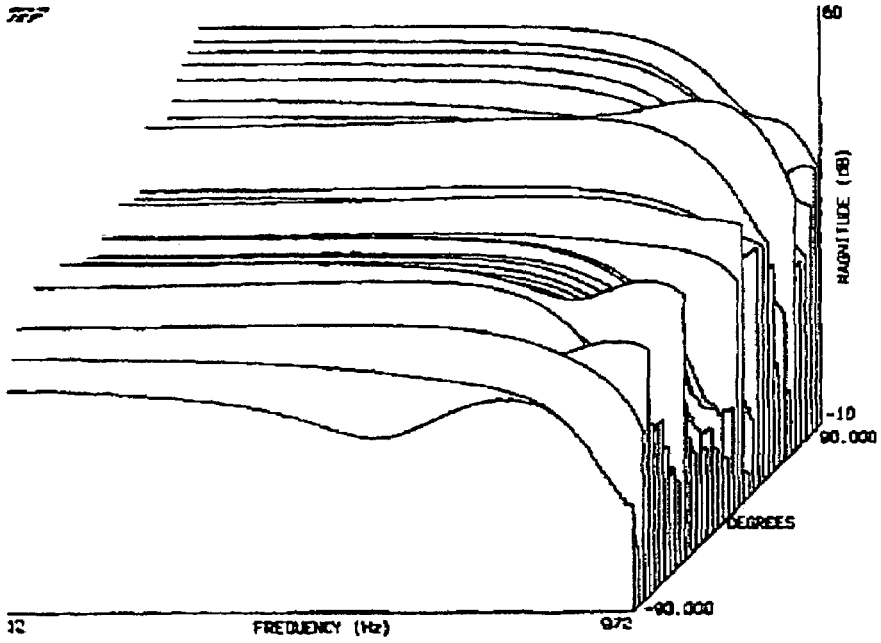
FIG. 17, a waterfall type diagram taken from the same setup as FIGS. 14 and 15, shows the almost total linearity of the grouped diffusers of the subject invention, for the 12-970 Hz bandwidth.
Figure 19:
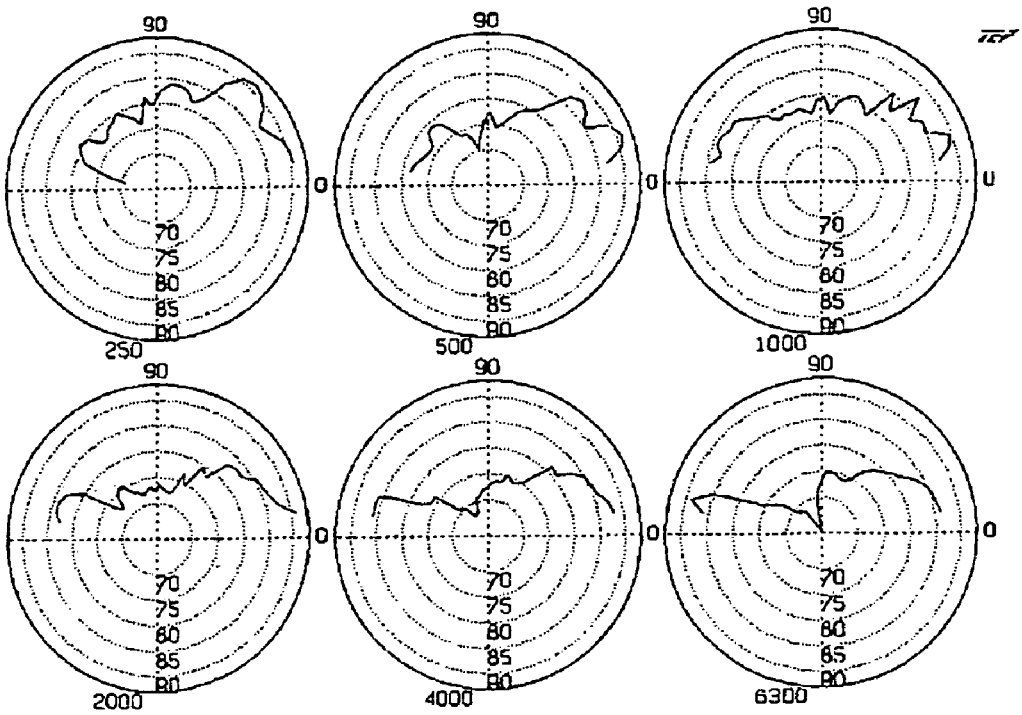
FIG. 19 is an example from bibliography indicating a polar plots diagram for gypsum diffuser of a pyramid shape. The irregularities are obvious and tend to the ones taken from a hard plane surface, as are all typical walls.
Figure 20:
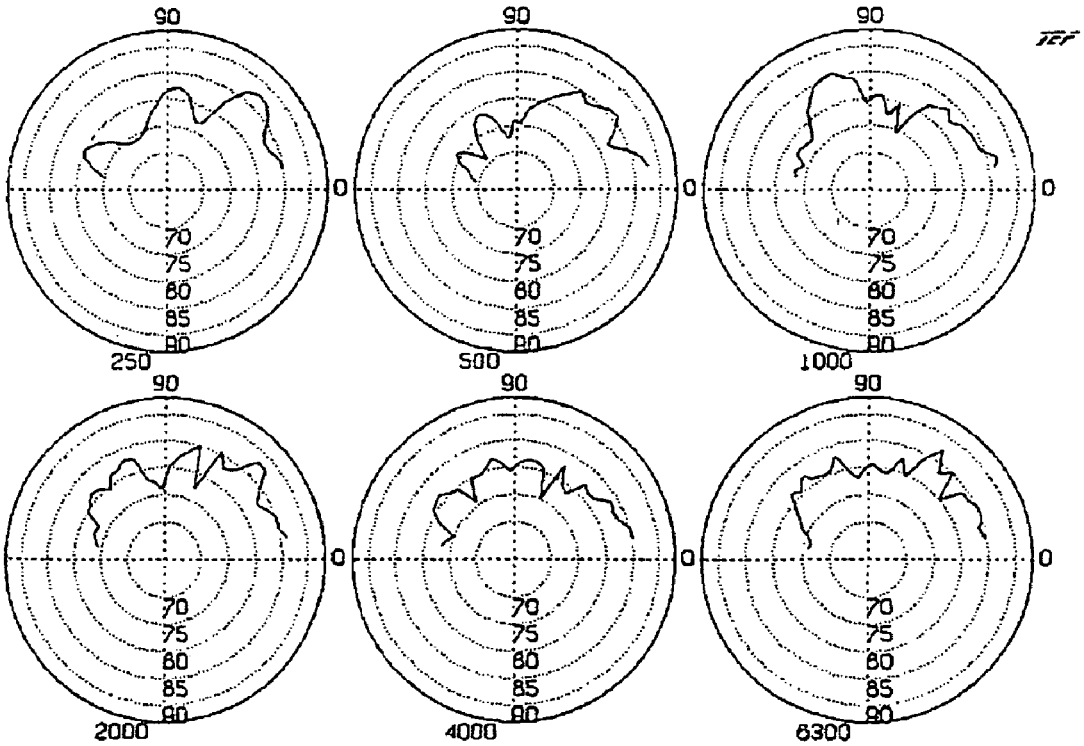
FIG. 20 is an example from bibliography indicating a polar plots diagram for a diffuser from another invention (a Schroeder type). Until now it was considered one of the best commercial applications. The irregularities of his polar plots indicates how much and which directions besides of his diffusing capability is doing a harmful absorption, harmful there where the music have all his beauties—in the mid and high range where also the human hearing is most sensitive.

The uniformity of diffusion is characterized by the standard deviation of the ⅓-octave polar response, for a given angle of incidence. For each of the 37 angles of incidence, 37 backscattering impulse response measurements are made at 50 increments between 0° and 180°. The Diffusion Coefficient is the mean standard deviation for all angles of incidence normalized to the standard deviation of a delta function A, noted D. When D equals one, D=1, we have ideal diffusion and the resulted curve it is or tends to a semicircle. (FIG. 13). Then, when D=1, means that the designed acoustical diffuser have maximum diffusing capability and the absorption resulted from his surface geometry is minimized.

Figure 21:
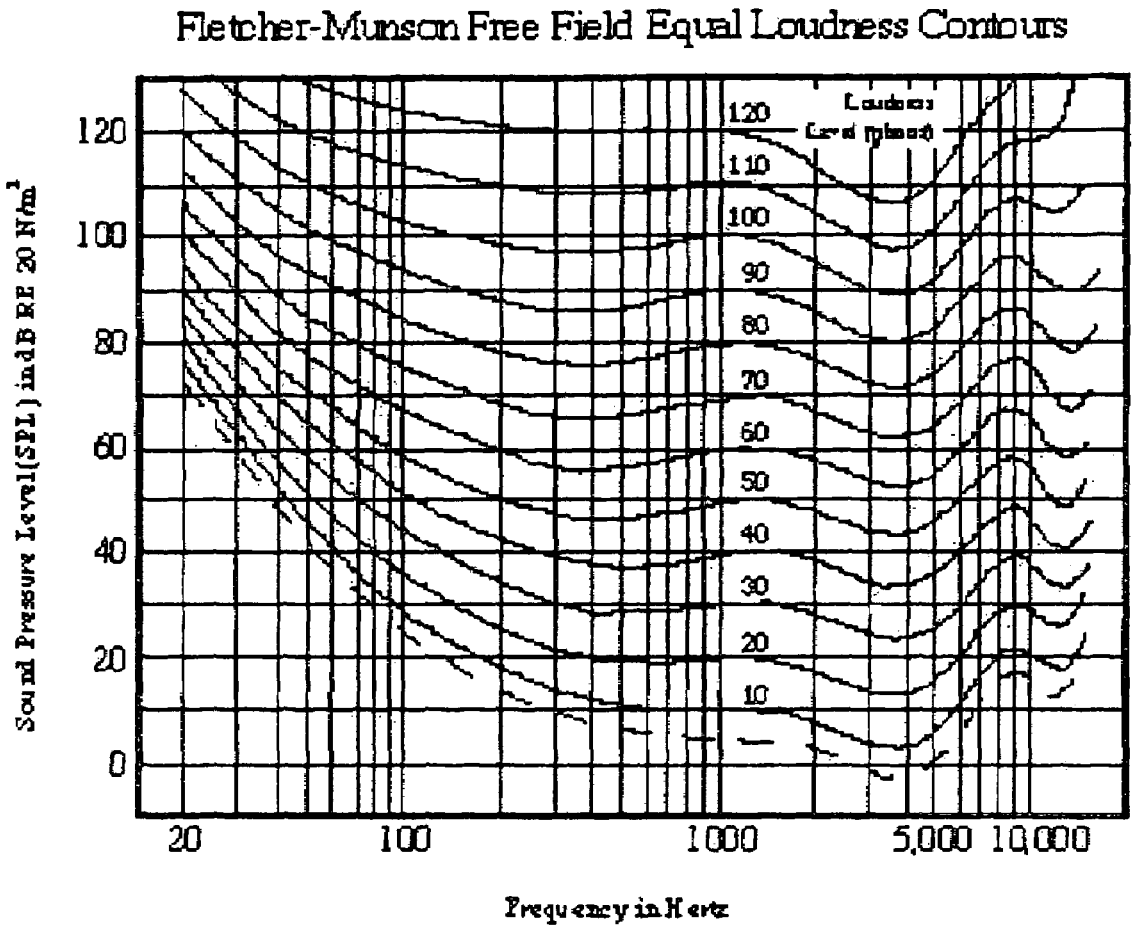
FIG. 21 is the "Equal loudness curves in a free field experiment—Fletcher-Munson".

Referring to FIG. 21, the human hearing is less sensitive for low frequencies relative to the mid and high ones. As mentioned above, the lower frequencies are responsible for the harmful masking that they impose towards the mid and higher ones. There are also the so named sub-harmonics, phenomenon perceived especially in small rooms. Their low frequencies contents is much lower than the loudspeakers frequency response and are related with the biggest room dimension, loudspeakers placement and with the complex collaboration of all existent audio parameters, not only at a theoretical level but much more on real life applications, and always was and will be difficult to analyze it and calm them. Speaking music, as much the low and very low frequency energy will overflow the dedicated room for listening, as much all kind of masking phenomena will cover the mid and high frequency contents and along with them and our clean perception and pleasure. The clean diffusing done by the grouped diffuser of subject invention permits a reconstructing the initial "aura" envelope from the room's recording session—his 3D diffusing lobe field may be sensed and measured at more than 6-7 meters, and for a trained person, at much more distances, as 12-14 meters. The new design of the acoustical diffuser said apparatus offers the industry's highest diffusion quality providing a natural sounding ambiance and the most effective diffusive control of interfering reflections. Then, the sweet spot becomes obsolete, meaning that almost every person in the room senses the same sound mix.

After more than one year from which the apparatus of the subject invention from FIG. 1 entered in industrial production and commercial phases, I still believe that without the God's help or an exceptionally sudden inspiration, an invention like this wouldn't be possible.

Finally, if we compare the Fletcher-Munson's loudness curves with FIG. 18—a full range apparatus measurement, we perceive that they are almost seamless mirror looked. This means that the apparatus of the subject invention diffuses and in the same time absorbs the low frequencies in a statistical way as our hearing system does. The algebraic addition of the mentioned curves tends to linearity for the tow frequency, working like an inverse automatic wide range digital equalizer, his power supply being the music only. These are facts easy to be perceived and measurable.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

TABLE T1

| | | | |
|---|---|---|---|
| FIELD OF SEARCH | 181/286, 287, 288, 290 293, 295, 296, 30, 150 | | |
| U.S. Patent Documents (1) | | | |
| 2902854 | September 1959 | Greene | 181/150 |
| 3557901 | January 1971 | Young. | |
| 3721050 | March 1973 | Perina. | |
| 4029170 | June 1977 | Phillips. | |
| 4312420 | January 1982 | Gatti. | |
| 4365113 | December 1982 | Soma et al. | |
| 4428454 | January 1984 | Capaul et al. | |
| 4600619 | July 1986 | Chee et al. | |
| 4661392 | April 1987 | Kapstad. | |
| 4702046 | October 1987 | Haugen et al. | |
| 4821839 | April 1989 | D'Antonio et al. | 181/286 |
| 4964486 | October 1990 | D'Antonio et al. | |
| 4967872 | November 1990 | Hart. | |
| 5027920 | July 1991 | D'Antonio et al. | |
| 5117598 | June 1992 | Livingston et al. | |
| 5160816 | November 1992 | Chlop. | |
| 5193318 | March 1993 | D'Antonio et al. | |
| 5226267 | July 1993 | D'Antonio et al | |
| 5548656 | August 1996 | Weisel. | |
| 5587564 | December 1996 | Stief et al. | |
| 5780785 | July 1998 | Eckel | 181/295 |
| Foreign Patent Documents (2) | | | |
| 0 015 245 | September 1980 | EP. | |
| 0 024 461 | March 1981 | EP. | |
| 0 257 483 | March 1988 | EP. | |
| 0 438 384 A1 | July 1991 | EP. | |
| 560702 | September 1993 | EP. | |
| 0 257 483 B1 | April 1994 | EP. | |
| 0 777 403 A2 | June 1997 | EP. | |
| 2451520 | May 1976 | DE. | |
| 639164 | January 1982 | CH. | |

TABLE 2

| International bibliography related with diffusers: theory, design, measurements, classification |
|---|
| 1. D'ANTONIO, P., The Directional Scattering Coefficient: Experimental Determination, J. Audio Eng. Soc. 40, No. 12. 997–1017 (December 1992). |
| 2. D'ANTONIO, P., KONNERT, J. H. and KOVITZ, P. The Disc Project. Experimental Measurement of the Directional Scattering Properties of Architectural Acoustic Surfaces, IpAAd2, 14 \| 144 (June 1994). |
| 3. COX, T. J. and LAM, Y. W. Evaluation of Methods by Predicting the Scattering from Simple Rigid Panels. Applied Acoustics. 123–140 (1993). |
| 4. COX, T. J. and LAM, Y. W., Prediction and Evaluation of the Scattering from Quadratic Residue Diffusers, J. Acoust. Soc. Am. 95(I). 297–305. (1994). |
| 5. ISO 66: 1997, Acoustics - Preferred frequencies. Geneva, Switzerland: International Organization for Standardization. |
| 6. IEC 61260 (1995-08) Electroacoustics - Octave-band and fractional-octave-band filters. Geneva, Switzerland: International Electrotechnical Commission. |
| 7. DRAFT AES-4id-xxxx, AES information document for room acoustics and sound reinforcement systems-Characterization and measurement of surface scattering uniformity, AES 2000. |

The invention claimed is:

1. A wide band sound diffuser with self regulated low frequency absorption, said wide band sound diffuser comprising: a center hemisphere like shape (1) which is confined and intersecting an octagon truncated pyramid (2); wherein said octagon truncated pyramid (2) intersects on each of its four sides, respectively, four symmetrical one quarter cylinder like shapes (3); said octagon truncated pyramid (2) also intersects four symmetrical quarter-hemisphere like shapes (4), each located on the corners of said diffuser; wherein each symmetrical quarter-hemisphere like shape (4) consists of a quarter-hemisphere like shape embedded into a prism wherein each base prism intersects another lateral side of the central octagon truncated pyramid (2) at the remaining four sides, the angles between all intersected shapes are the same; wherein at least 90% of said diffuser surface being convex therefore diffusing; wherein said apparatus comprises two lateral rigid supports (5) glued or produced as one with the main body, and positioned on the inside of said diffuser on an opposite face by two T-shaped rails (6); wherein the two T-shaped wooden rails are mounted on a wall or ceiling surface with screws or nails; wherein at least four of said wide band sound diffusers are mounted together at a distance from one another, such that the rigid supports (5) and T-shaped rails (6) of each diffuser is in tight mechanical contact with one another; wherein the at least four diffusers, at their nearest and common contact points display together a new three dimensional shape which consists of a sphere like shape embedded into a base prism; wherein each base prism intersects a lateral side of the central truncated pyramid (2), and the angle between each three dimensional shape is the same along the four created directions, like a cross; from the common point of the one-quarter cylinder like shape forms hemisphere like shapes, all being symmetrical towards two perpendicular axes and respectively towards two diagonal axes; wherein the common point of each of the four diffusers forms a small inward decreasingly curvature which serves to avoid central sphere reflections and optimize more local diffusion; wherein a small cross from four concave curvatures is formed on top of each shape (1); wherein two T-shaped rails (6) are made from wood or any suitable material, and may be steady mounted parallel or perpendicular to the ground or similarly on a ceiling, providing two lateral supporting surfaces for the grouped apparatus; wherein the remaining two sides are not sealed relative to the supporting surface, the distance between their bottom side and the supporting surface being equal to the height of the two T-shaped rails (6); wherein air circulates freely in one direction on many parallel columns; wherein the resulting parallel surfaces behaves like hard plates steady supported at the two longer edges; wherein an empty space behind each diffuser follows their back geometry and the resulted geometry from the grouped diffuser forms a Helmholtz resonator; where the lower frequencies are related to the inside highest points of the diffusers main body relative to the supported wall, and to the largest dimension of the grouped diffusers; wherein the group mounted diffusers comprise at least two columns of diffusers in very tight contact, creating air resonance behind each of the grouped diffusers resonating at almost the same sound source spectral contents but, not at the same sound levels, resulting in the rooms standing waves being continuously variable and following their natural distribution; and said diffuser having linearity for the low frequency and the diffusing capability of an inverse ultra fast automatic and signal adaptable wide range digital equalizer.

2. A wide band sound diffuser with self regulated low frequency absorption according to claim 1, and further comprising: a base (11) molded from thermo-formable plastics, having an area equal to the apparatus main body minus a wall thickness; wherein each of the four corners of the diffuser body comprises a first set of plastic cylindrical members (10) glued to said base (11); wherein the four respective edges of said main body comprise a second set of four cylindrical members (9) glued below an inner surface, and having a slightly different interior diameter from said first set of cylindrical members (10); wherein the second set of four cylindrical members (9) are each inserted into a respective one of a first set of cylindrical members (10); wherein the tight contact between them permits controlled movements; wherein each of the first (10) and second (9) sets of cylindrical members in tight contact further comprises a spring member (12) mounted and preloaded inside the cylinders (9 and 10), between the base (11) and a limiter (8); wherein the limiter (8) is parallel with the base (11) surface and allows the spring (12) to function; wherein the variable mechanical connection between the base (11) and the main diffuser body is provided by an endless screw (15) extending through the base and being secured on an outer portion of the base (11) by a screw-nut (16); wherein the endless-screw (15) has a fixed portion (13) centered between the lower side of the central hemisphere (1) through a hole (17), and positioned relative to the geometrical center of the base (11), and adhered with glue; wherein said endless-screw (15) and said fixed portion (13) are formed from any type of hard plastics; wherein the endless-screw (15) function is secured by an adjusting key with a cross like section, and inserted trough the hole (17) coaxial into the endless-screw moving part at a center point (18); wherein a centrally located spring (14) is secured and aligned by a thin inner plastic cylinder (20) covering the endless-screw (15); wherein the centrally located spring (14) provide a continuous loading between the diffuser's main body and the base (11); wherein the force provided by the preloading of all four corner springs must be equal to the centrally located screw-nut spring (14); wherein all of the springs (12 and 14) do not permit any kind of vibration of the suspended portions wherein a group of diffusers must all be adjusted by the adjusting key to have an equal distance between the main diffuser body and the base (11); wherein the base (11) is mounted against a support surface of a wall or ceiling surface by screws from the three holes (19) arranged in a triangle disposition for an easier alignment; wherein the diffuser body is fabricated from hard impact polystyrene or any other suitable material by thermoforming, injection molding or blow molding; and wherein the internal mechanism and base (11) having all required supports being adhered with adhesives or produced from the same material as one piece with the diffuser device main body.

3. A wide band sound diffuser with self regulated low frequency absorption according to claim 2, and further comprising: wherein the endless-screw has the possibility of a variable main body location relative to the base (11), thus permitting a lower fundamental frequency resonance to be between about 30 Hz and 1 Hz at the maximum distance of the main body relative to the base, simultaneously providing a clean diffusion at least for the standard 250-6300 Hz band.

* * * * *